US006672089B2

(12) United States Patent
Park et al.

(10) Patent No.: US 6,672,089 B2
(45) Date of Patent: Jan. 6, 2004

(54) APPARATUS AND METHOD FOR CONTROLLING REFRIGERATING CYCLE OF REFRIGERATOR

(75) Inventors: Jin Su Park, Changwon (KR); Jun Heon Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 139 days.

(21) Appl. No.: 09/925,007

(22) Filed: Aug. 9, 2001

(65) Prior Publication Data

US 2002/0043073 A1 Apr. 18, 2002

(30) Foreign Application Priority Data

Oct. 12, 2000 (KR) ..... 2000-59923
Oct. 17, 2000 (KR) ..... 2000-60856
Oct. 17, 2000 (KR) ..... 2000-60857
Oct. 24, 2000 (KR) ..... 2000-62501

(51) Int. Cl.[7] ..... F25B 39/02
(52) U.S. Cl. ..... 62/199; 62/157; 62/527
(58) Field of Search ..... 62/199, 200, 441, 62/198, 197, 205, 206, 525, 526, 527, 157, 158, 231

(56) References Cited

U.S. PATENT DOCUMENTS 4,537,041 A * 8/1985 Denpou et al. ..... 62/199
6,185,948 B1 * 2/2001 Niki et al. ..... 62/199
6,370,908 B1 * 4/2002 James ..... 62/199 X

FOREIGN PATENT DOCUMENTS

GB 1314341 * 4/1973 ..... 62/199
JP 53-91446 * 8/1978 ..... 62/199
WO WO 99/42771 * 8/1999 ..... 62/199

* cited by examiner

*Primary Examiner*—Harry B. Tanner
(74) *Attorney, Agent, or Firm*—Fleshner & Kim, LLP

(57) ABSTRACT

In a refrigerator using a evaporator, and particularly in an apparatus and a method for controlling a refrigerating cycle of a refrigerator which is capable of easily switching a three-way stepping motor valve, by adjusting a flow of a refrigerant in a refrigerating cycle by using a three-way stepping motor valve, noise occurred in the conventional valve switching can be reduced, a power consumption of a three-way stepping motor valve can be reduced.

20 Claims, 20 Drawing Sheets

APPARATUS AND METHOD FOR CONTROLLING REFRIGERATING CYCLE OF REFRIGERATOR

BACKGROUND OF THE INVENTION

1. Field of the Invention

The present invention relates to refrigerator, and in particular to an apparatus and a method for controlling a refrigerating cycle of a refrigerator with a stepping motor valve.

2. Description of the Prior Art

Generally, a refrigerating apparatus adjusts a temperature by controlling a high temperature-high pressure refrigerant circulating in a refrigerating cycle of the refrigerating apparatus itself. Herein, the refrigerating apparatus can be a refrigerator and an air conditioner, etc.

Hereinafter, a refrigerator in accordance with the prior art will now be described with reference to the accompanying FIG. 1.

FIG. 1 is a block diagram illustrating a refrigerating cycle of a refrigerator in accordance with the prior art.

As depicted in FIG. 1, a refrigerating cycle of a refrigerator in accordance with the prior art includes a compressor 11 compressing a refrigerant, a condenser 12 radiating heat of the refrigerant compressed in the compressor 11, a drier 13 installed at the condenser 12 and removing moisture from the refrigerant, a refrigerant pipe connected to the drier 13, a first and a second solenoid valves 14, 15 connected to the refrigerant pipe and adjusting opening and shutting of the refrigerant pipe, a first and a second expansion valves 16, 17 separately connected to the first and the second solenoid valves 14, 15 and depressing the refrigerant discharged from the first and the second solenoid valves14, 15, and a first and a second evaporators 18, 19 separately connected to the first and the second expansion valves 16, 17 and generating cold air in order to absorb heat of a foodstuff preserved in a chilling chamber or a freezing chamber. Herein, the first and the second evaporators 18, 19 are connected to the compressor 11 through the refrigerant pipe. In more detail, the refrigerant cycle in accordance with the prior art is constructed in the order of the compressor 111 the condenser 12 <the drier 13→the first and the second expansion valves 16, 17→the first and the second evaporators 18, 19→the compressor 11. In addition, the compressor 11, the condenser 12, the drier 13, the first and the second expansion valves 16, 17, the first and the second evaporator 18, 19, and the compressor 11 are connected through the refrigerant pipes.

In the meantime, when a plurality of the first and the second evaporators 18, 19 are installed in the refrigerator, it is possible to control supply of the cold air inside the freezing chamber and the chilling chamber. In more detail, a refrigerating cycle can be constructed in the order of the compressor 11 the condenser 12→the drier 13→the first expansion valves 16→the first evaporator 18→the compressor 11 or the compressor 11→the condenser 12→the drier 13→the second expansion valve 17→the second evaporator 19→the compressor 11 or the compressor 11 the condenser 12→the first and the second expansion valves 16, 17→the first and the second evaporators 18, 19→the compressor 11 in accordance with opening and shutting operations of the first and the second solenoids valves 14, 15.

Accordingly, if a structure constructed with the first solenoid valve 14, the first expansion valve 16 and the first evaporator 18 is for controlling the cold air inside the freezing chamber of the refrigerator, a structure constructed with the second solenoid valve 15, the second expansion valve 17 and the second evaporator 19 is for controlling the cold air inside the chilling chamber of the refrigerator. Hereinafter, the refrigerating cycle of the refrigerator in accordance with the prior art will now be described with reference to the accompanying FIG. 2.

FIG. 2 is a block diagram illustrating a microcomputer controlling the refrigerating cycle of the refrigerator in accordance with the prior art.

First, a microcomputer 21 recognizes a preset temperature of the chilling chamber and the freezing chamber of the refrigerator. The microcomputer 21 controls the refrigerating cycle for generating the cold air when the temperature of the chilling chamber and the freezing chamber is higher than the preset temperature.

The compressor 11 compresses the refrigerant so as to be a high temperature-high pressure refrigerant in accordance with control of the microcomputer 21. The refrigerant compressed in the compressor 11 is discharged into the condenser 12 through the refrigerant pipe.

The condenser 12 radiates heat of the refrigerant flowed from the compressor 11 and discharges the refrigerant into the drier 13.

The drier 13 removes humidity from the refrigerant passing through the condenser 12 and discharges it into the first and the second expansion valves 16, 17. Herein, the refrigerant passed through the drier 13 is discharged into the first 16 or the second expansion valve 17 when the first 14 or the second solenoid valve 15 is in the shutting state.

The first 14 and the second solenoid valve 15 are opened and shut in accordance with a control signal of the microcomputer 21. In more detail, the microcomputer 21 detects a storage (freezing chamber or chilling chamber) required cold air by comparing the preset temperature with a present temperature of the freezing chamber or the chilling chamber and turns off the operation of the first 14 or the second solenoid valve 15 connected to the detected storage (freezing chamber or chilling chamber). For example, when the microcomputer 21 turns off only the operation of the first solenoid valve 14, the refrigerant is discharged into the first evaporator 18 through the first expansion valve 16. On the contrary, when the microcomputer 21 turns off only the second solenoid valve 15, the refrigerant is discharged into the second evaporator 19 through the second expansion valve 17.

Accordingly, the refrigerant is discharged into the first 16 or the second expansion valve 17 through the first 14 or the second solenoid valve 15 in accordance with the control of the microcomputer 21.

The first and the second expansion valves 16, 17 depress the high refrigerant passed through the first and the second solenoid valves 14, 15, adjust the refrigerant so as to flow as a certain ratio in order to make the refrigerant evaporate easily, and discharge the refrigerant to the first and the second evaporators 18, 19.

The first and the second evaporators 18, 19 supply cold air to the freezing chamber and the chilling chamber in order to absorb heat inside the freezing chamber and the chilling chamber by being supplied the refrigerant through the first and the second expansion valves 16, 17.

Accordingly, the cold air absorbing the heat inside the freezing chamber and the chilling chamber is transformed into an evaporation state by the first and second evaporators 18, 19. The refrigerant transformed into the evaporation state flows into the compressor 11. Accordingly, a refrigerating cycle is constructed as described above. Herein, the high pressure-high temperature refrigerant is converted into the low pressure-low temperature refrigerant and again it is converted into the high pressure-high temperature refrigerant while circulating in the refrigerating cycle. In more detail, the refrigerant inside the refrigerating cycle performs heat exchange while circulating in the condenser 12 and the first 18 or the second evaporator 19.

In the meantime, in a case of a refrigerating cycle of a refrigerator constructed with the plurality of evaporators 18, 19, the refrigerating cycle is constructed through the first and the second solenoid valves 14, 15 in an open state in accordance with a control signal of the microcomputer 21, the refrigerating cycle is variously controlled in accordance with a temperature inside the freezing chamber and the chilling chamber. For example, when the freezing chamber connected with the first solenoid valve 14 is in need of the cold air supply, the first solenoid valve 14 is opened by the microcomputer 2 and the refrigerant circulates in the refrigerating cycle. On the contrary, when the chilling chamber connected to the second solenoid valve 15 is in need of the cold air supply, the second solenoid valve 15 is opened by the microcomputer 21 and the refrigerant circulates in the refrigerating cycle.

In the meantime, when both the first and the second solenoid valves 14, 15 are opened by the control signal of the microcomputer 21, the refrigerant circulates in the refrigerating cycle. On the contrary, when both the first and the second solenoid valves 14, 15 are shut by the control signal of the microcomputer 21, the refrigerant can not circulate in the refrigerating cycle.

In the refrigerator according to the prior art, the refrigerating cycle is constructed by the opening and shutting of the two-way solenoid valves 14, 15 connected to the freezing chamber or the chilling chamber. Hereinafter, the two-way solenoid valves 14, 15 will be described in detail with reference to the accompanying FIG. 3.

FIG. 3 is a sectional view illustrating a structure of a two-way solenoid used for a refrigerating cycle of a refrigerator in accordance with the prior art.

As depicted in FIG. 3, the two-way solenoid valve in accordance with the prior art includes a plunger 34 installed at the center of the two-way solenoid valve and movable up and down, a plurality of coils 31 installed at the circumference of the plunger 34 and controlling the up and down movement of the plunger 34, a sealing ball 35 installed at the lower end of the plunger 34, an input port 33 and an output port 36 opened and shut by the sealing ball 35 installed at the lower end of the plunger 34, and a spring 32 installed at the upper portion of the plunger 34 and transferring the plunger 34 downwardly. Herein, the input port 33 and the output port 36 are connected each other. The operation of the two-way solenoid valve in accordance with the prior art will be described as below.

First, when power is applied to the plurality of coils 31, the plurality of coils 31 transfers the plunger 34 upwardly by an electromagnetic principle. Herein, the sealing ball 35 shutting the connection between the input port 33 and the output port 36 is transferred upwardly same as the plunger 34, accordingly the input port 33 and the output port 36 are connected.

On the contrary, when power is cut off, the plunger 34 is transferred downwardly by the spring 32. In more detail, when the plunger 34 is trasnferred downwardly, the sealing ball 35 installed at the lower end of the plunger 34 shuts the connection between the input port 33 and the output port 36.

However, in the two-way solenoid valves 14, 15 used for the refrigerating cycle of the refrigerator in accordance with the prior art, an impact noise occurs while the plunger 34 moves up and down.

In addition, in the refrigerator in accordance with the prior art, two two-way solenoid valves are used, an additional T-shape type refrigerant pipe is required between the two-way solenoid valves 14, 15 and the drier 13, and a welding for connecting the T-shape type refrigerant pipe and a wiring between the first and the second solenoid valves 14, 15 and the microcomputer 21 have to be performed.

As described above, in the refrigerator in accordance with the prior art, an impact noise occurs according to the transferring of the plunger 34.

In addition, in the refrigerator in accordance with the prior art, because the two-way solenoid valves are used in order to construct the refrigerating cycle at the freezing chamber and the chilling chamber and the two-way solenoid valves are separately controlled, power consumption is high.

In addition, in the refrigerator in accordance with the prior art, because two two-way solenoid valves are used, an additional T-shape type refrigerant pipe is required between the two-way solenoid valves 14, 15 and the drier 13, and a welding for connecting the T-shape type refrigerant pipe and a wiring between the first and the second solenoid valves 14, 15 and the microcomputer 21 have to be performed.

SUMMARY OF THE INVENTION

It is an object of the present invention to provide an apparatus and a method for controlling a refrigerating cycle of a refrigerator which is capable of controlling a flow of a refrigerant by using a three-way stepping motor valve in a refrigerator using a plurality of evaporators.

It is a further object of the present invention to provide an apparatus and a method for controlling a refrigerant cycle of a refrigerator which is capable of reducing a noise and a power consumption by controlling a flow of a refrigerant by using a three-way stepping motor valve in a refrigerator using a plurality of evaporators.

It is another object of the present invention to provide an apparatus and a method for controlling a refrigerant cycle of a refrigerator which is capable of easily switching a three-way stepping motor valve by reducing a refrigerant pressure at an inlet side of the three-way stepping motor valve having a plurality of output ports.

It is still another object of the present invention to provide an apparatus and a method for controlling a refrigerant cycle of a refrigerator which is capable of operating a request refrigerating cycle according to a switching mode of a three-way stepping motor valve by facilitating switching of the three-way stepping motor valve.

It is yet another object of the present invention to provide an apparatus and a method for controlling a refrigerant cycle of a refrigerator which is capable of preventing a compressor from stopping during the operation by reducing a refrigerant suction pressure and a refrigerant discharge pressure of the compressor.

In order to achieve the above-mentioned objects, in a refrigerating apparatus supplying cold air to a freezing chamber and a chilling chamber by constructing a refrigerating cycle, there is provided an apparatus for controlling a refrigerating cycle in accordance with the present invention including a microcomputer outputting a control signal, a compressor compressing a coolant, a three-way stepping motor valve passing or shutting a refrigerant discharged from the compressor in accordance with the control signal and discharging the passed refrigerant into a plurality of directions, and a plurality of evaporators separately supplied the refrigerant discharged into the plurality of directions and supplying cold air to a freezing chamber and a chilling chamber.

In order to achieve the above-mentioned objects, in a method for controlling a refrigerating cycle by installing a three-way stepping motor valve to a refrigerating apparatus having a plurality of evaporators, there is provided a method for controlling a refrigerating cycle in accordance with the present invention including rotating a rotor inside a three-way stepping motor valve in a clockwise direction at the most, transferring the rotor to a preset initial position, and rotating the rotor at the initial position according to a preset rotation value of the rotor in a clockwise direction or a counter-clockwise direction.

In order to achieve the above-mentioned objects, there is provided an apparatus for controlling a refrigerating cycle in accordance with the present invention including a microcomputer outputting a control signal, a compressor compressing a refrigerant, a condenser condensing the refrigerant, a first expansion valve reducing a pressure of the refrigerant passed through the condenser, a n-direction stepping motor valve selectively shutting or carrying the refrigerant passed through the first expansion valve according to the control signal, a second expansion valve reducing a pressure of the refrigerant discharged from the n-direction stepping motor valve, and a plurality of evaporators being supplied the refrigerant discharged through the second expansion valve and supplying cold air to a freezing chamber and a chilling chamber.

In order to achieve the above-mentioned objects, there is provided an apparatus for controlling a refrigerating cycle in accordance with the present invention including a microcomputer outputting a control signal, a compressor compressing a refrigerant, a condenser condensing the refrigerant, a first expansion valve reducing a pressure of the refrigerant passed through the condenser, a n-direction stepping motor valve selectively shutting or carrying the refrigerant passed through the first expansion valve according to the control signal discharging the passed refrigerant into a plurality of directions, and a plurality of evaporators being supplied the refrigerant discharged into the plurality of directions and supplying cold air to a freezing chamber and a chilling chamber.

In order to achieve the above-mentioned objects, there is provided an apparatus for controlling a refrigerating cycle in accordance with the present invention including a compressor compressing a refrigerant, a three-way stepping motor valve opening and shutting a refrigerant pipe connecting a freezing chamber and a chilling chamber so as to supply the refrigerant generated in the compressor through the refrigerant pipe, a counter counting an early refrigerating time according to an early operation of the compressor, and a microcomputer switching the three-way stepping motor valve on the basis of the counted early refrigerating time.

In order to achieve the above-mentioned objects, in a method for controlling a refrigerating cycle of a refrigerator being supplied a refrigerant compressed in a compressor and evaporating the refrigerant, there is a method for controlling a refrigerating cycle in accordance with the present invention including opening and shutting a refrigerant pipe so as to supply the refrigerant generated in the compressor to a freezing chamber and a chilling chamber through the refrigerant pipe, counting an early refrigerating time according to an early operation of the compressor, judging whether the early refrigerating time exceeds a preset time, and opening and shutting selectively the refrigerant pipe connected to the freezing chamber and the chilling chamber when the early refrigerating time exceeds the preset time.

In order to achieve the above-mentioned objects, in an apparatus for controlling a refrigerating cycle of a refrigerator including a compressor compressing a refrigerant, a condenser condensing and liquefying the refrigerant compressed in the compressor, an expansion valve connected to the condenser and depressing the refrigerant discharged from the condenser and an evaporator being supplied the refrigerant discharged from the expansion valve and generating cold air in order to absorb heat inside a foodstuff preserved in a freezing chamber or a chilling chamber, there is provided an apparatus for controlling a refrigerating cycle in accordance with the present invention including a microcomputer operating the refrigerating cycle for a preset time in an early operation state of the refrigerating cycle and switching the refrigerating cycle into a normal operation mode after a certain time.

In order to achieve the above-mentioned objects, in a plurality of refrigerating cycles operated by being supplied a refrigerant generated in a compressor, there is provided a method for controlling a refrigerating cycle in accordance with the present invention including judging whether a refrigerating cycle is in an early operation mode, judging whether an operation time of the refrigerating cycle exceeds a preset time, and switching the refrigerating mode into a normal mode after passing the preset time.

DETAILED DESCRIPTION OF THE PREFERRED EMBODIMENT

Hereinafter, an apparatus and a method for controlling a refrigerating cycle of a refrigerator in accordance with the present invention will be described with reference to accompanying FIGS. 4~27.

Figure 1:
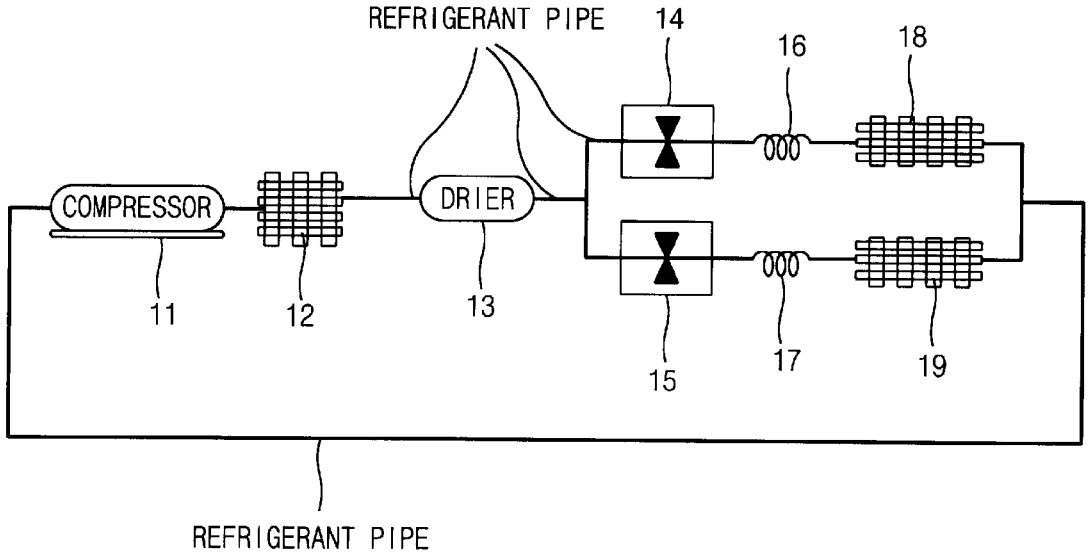
FIG.1 CONVENTIONAL ART
FIG. 1 is a block diagram illustrating a refrigerating cycle of a refrigerator in accordance with the prior art.
Figure 2:
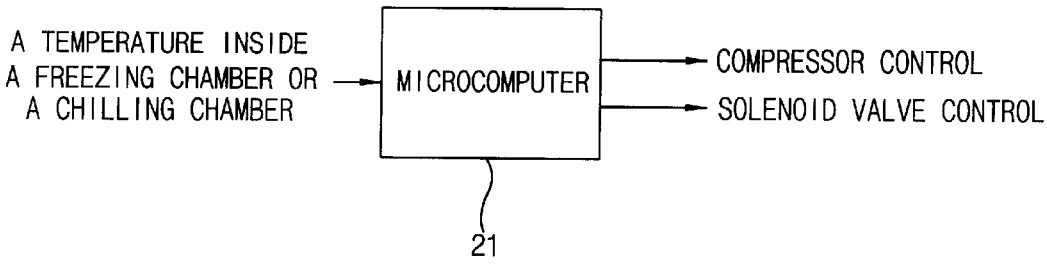
FIG.2 CONVENTIONAL ART
FIG. 2 is a block diagram illustrating a microcomputer controlling a refrigerating cycle of a refrigerator in accordance with the prior art.
Figure 3:
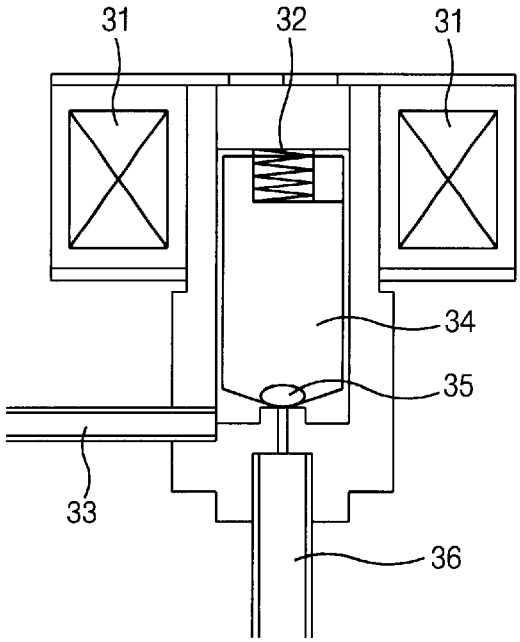
FIG.3 CONVENTIONAL ART
FIG. 3 is a sectional view illustrating a two-way solenoid valve used in a refrigerating cycle of a refrigerator in accordance with the prior art.
Figure 4:
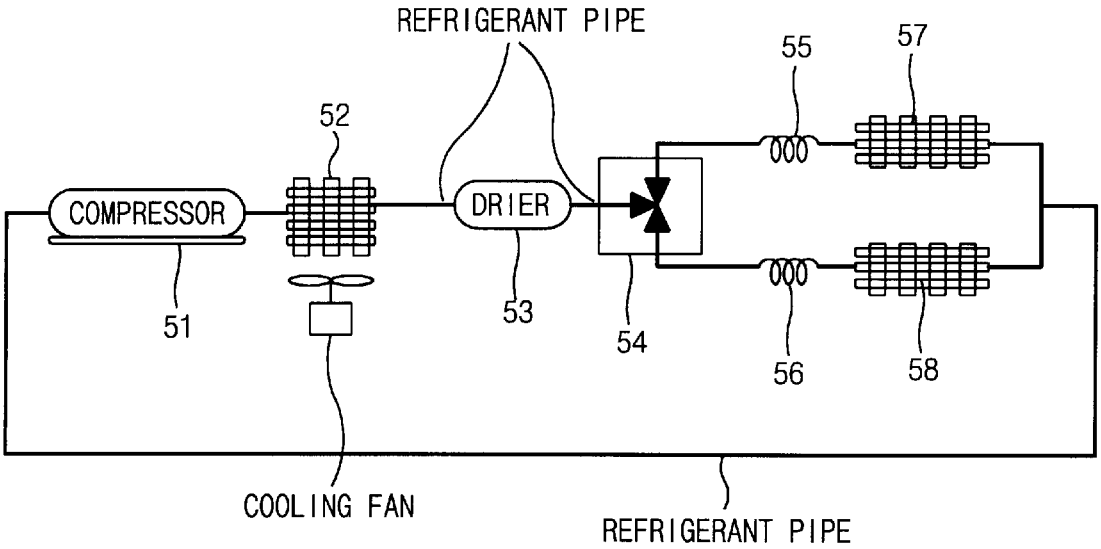
FIG. 4 is a block diagram illustrating a refrigerating cycle of a refrigerator in accordance with a first embodiment of the present invention.

FIG. 4 is a block diagram illustrating a refrigerating cycle of a refrigerator in accordance with a first embodiment of the present invention.

As depicted in FIG. 4, a refrigerating cycle of a refrigerator in accordance with the first embodiment of the present invention includes a compressor 51 compressing a refrigerant, a condenser 52 radiating heat of the refrigerant compressed in the compressor 51, a drier 53 connected to the condenser 52 and removing humidity from the refrigerant, a three-way stepping motor valve 54 connected to the drier 53 and shutting or carrying the refrigerant discharge from the drier 53 according to a control signal of a microcomputer, a first and a second expansion valves 55, 56 separately connected to the three-way stepping motor valve 54 and depressing the refrigerant discharged from the three-way stepping motor valve 54, and a first and a second evaporators 57, 58 separately connected to the first and the second expansion valves 55, 56 and generating cold air in order to absorb heat of a foodstuff preserved in a freezing chamber or a chilling chamber. Herein, the first and the second evaporators 57, 58 are connected to the compressor 51 through a refrigerant pipe. In more detail, the refrigerating cycle of the refrigerator in accordance with the first embodiment of the present invention is constructed in the order of the compressor 51→the condenser 52→the drier 53→the first and the second expansion valves 55, 56→the first and the second evaporators 57, 58→the compressor 51.

In the meantime, the compressor 51, the condenser 52, the drier 53, the first and the second expansion valves 55, 56, the first and the second evaporators 57, 58, and the compressor 51 are connected by the refrigerant pipe. The operation of the refrigerating cycle of the refrigerator in accordance with the first embodiment of the present invention will be described.

First, the inlet side of the compressor 51 is connected to the outlet side of the first and the second evaporators 57, 57, the outlet side of the compressor 51 is connected to the inlet side of the condenser 52 through the refrigerant pipe in order to compress the refrigerant.

The outlet side of the condenser 52 is connected to the inlet side of the drier 53 through the refrigerant pipe and radiates heat of the refrigerant compressed in the compressor 51.

The outlet side of the drier 53 is connected to the inlet side of the three-way stepping motor valve 54 through the refrigerant pipe and removes humidity from the refrigerant discharged from the condenser 52.

The three-way stepping motor valve 54 selectively opens and shuts the refrigerant pipe connected to the first and the second expansion valves 55, 56 according to the control signal of the microcomputer. In more detail, the three-way stepping motor valve 54 opens or shuts the refrigerant pipe connected to the first expansion valve 55 or the refrigerant pipe connected to the second expansion valve 56 or all of the refrigerant pipe connected to the first and the second expansion valves 55, 56 by selectively opening or shutting the refrigerant pipe connected to the first and the second expansion valve 55, 56.

The outlet sides of the first and the second expansion valves 55, 56 are connected to the inlet sides of the first and the second evaporators 57, 58 in order to depress the refrigerant discharged from the three-way stepping motor valve 54 and discharge the depressed refrigerant into the first and the second evaporators 57, 58.

The outlet sides of the first and the second evaporators 57, 58 are connected to the inlet sides of the compressor 51 so as to generate cold air for removing heat from the foodstuff preserved in the refrigerator in order to preserve the foodstuff for a long time.

Accordingly, when the plurality of evaporators 57, 58 are included in the refrigerator, it is possible to control the supply of the cold air to the freezing chamber or the chilling chamber of the refrigerator. In more detail, by turning on or off the operation of the three-way stepping motor valve 54, a refrigerating cycle is constructed in the order of the compressor 51→the condenser 52→the drier 53→the first expansion valve 55→the first evaporator 57→the compressor 51 or the compressor 51→the condenser 52→the drier 53→the second expansion valve 56→the second evaporator 58→the compressor 51 or the compressor 51 the condenser 52→the drier 53→the first and the second expansion valves 55, 56→the first and the second evaporators 57, 58→the compressor 51.

Herein, the first expansion valve 55 and the first evaporator 57 connected to the three-way stepping motor valve 54 are for controlling cold air of the freezing chamber, the second expansion valve 56 and the second evaporator 58 connected to the three-way stepping motor valve 54 are for controlling cold air of the chilling chamber. The operation of the refrigerating cycle of the refrigerator according to the first embodiment of the present invention will be described with reference to accompanying FIG. 5.

Figure 5:
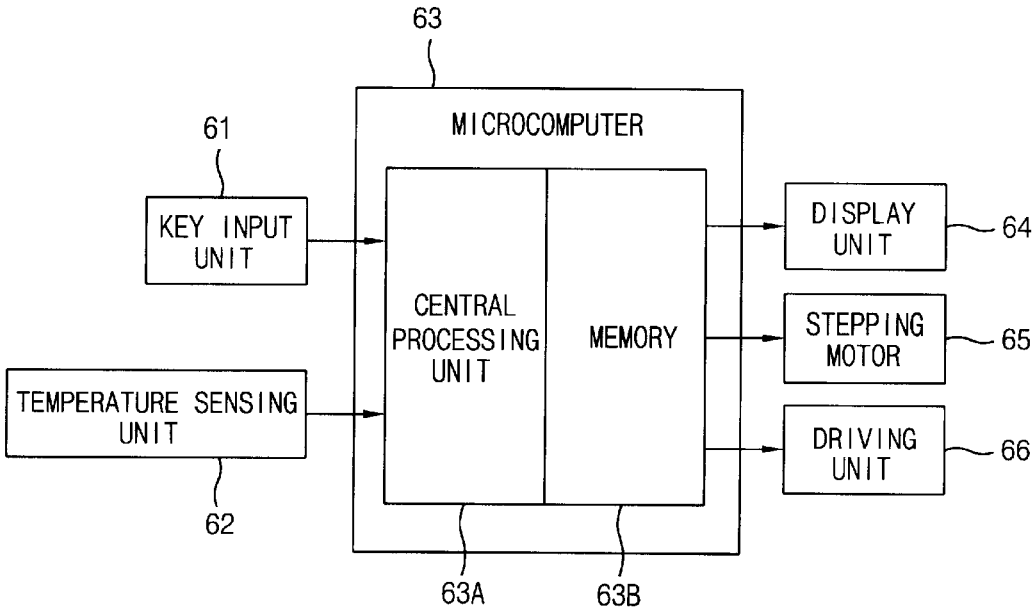
FIG. 5 is a block diagram illustrating an apparatus for controlling a refrigerating cycle of a refrigerator in accordance with the first embodiment of the present invention.

FIG. 5 is a block diagram illustrating an apparatus for controlling a refrigerating cycle of a refrigerator in accordance with the first embodiment of the present invention.

As depicted in FIG. 5, a refrigerating cycle of a refrigerator in accordance with the first embodiment of the present invention includes a key input unit 61 outputting a signal (information) according to a user's request, a temperature sensing unit 62 sensing a temperature inside a freezing chamber and a chilling chamber of a refrigerator, a microcomputer 63 controlling the operation of the refrigerating cycle on the basis of a temperature sensed in the temperature sensing unit 62 and a preset temperature, a display unit 64 displaying information inputted by a user through the key input unit 61 or the temperature sensed in the temperature sensing unit 62, a stepping motor 65 controlling the three-way stepping motor valve 54, and a driving unit 66 driving a cooling fan in order to cool the compressor 51 and the condenser 52. Herein, a CPU (Central Processing Unit) 63A controlling a system of the refrigerator and a memory 63B storing a program for controlling the preset temperature information and various operations are installed inside the microcomputer 63. Hereinafter, the operation of the refrigerating cycle of the refrigerator in accordance with the first embodiment of the present invention will be described with reference to accompanying FIGS. 4 and 5.

First, the microcomputer 63 compares the preset temperature stored in the memory 63B with the temperature of the freezing chamber or the temperature of the chilling chamber sensed from the temperature sensing unit 62, when the temperature of the freezing chamber or the temperature of the chilling chamber sensed from the temperature sensing unit 62 is higher than the preset temperature, the operation of the refrigerating cycle for generating cold air is controlled. In addition, in order to control the refrigerating cycle according to the temperature of the freezing chamber or the temperature of the chilling chamber sensed from the temperature sensing unit 62, the microcomputer 63 outputs a signal controlling opening and shutting of the three-way stepping motor valve 54 to the stepping motor 54.

The stepping motor 65 opens or shuts the refrigerant pipe connecting the three-way stepping motor valve 54 and the first expansion valve 55 according to the control signal of the microcomputer 79 or the refrigerant pipe connecting the three-way stepping motor valve 54 and the second expansion valve 56 according to the control signal of the microcomputer 79. In addition, the stepping motor 65 opens and shuts the refrigerant pipe connecting the three-way stepping motor valve 54, the first and the second expansion valves 55, 56.

After that, when the temperature of the freezing chamber or the temperature of the chilling chamber is lower than the preset temperature, the microcomputer 63 outputs a control signal driving the cooling fan to the driving unit 66.

The driving unit 66 drives the compressor 51 and the cooling fan according to the control signal of the microcomputer 63. Herein, the compressor 51 is driven by the driving unit 66 and generates a high temperature-high pressure refrigerant.

The high temperature-high pressure refrigerant generated in the compressor 51 is discharged into the condenser 52 through the refrigerant pipe, the condenser 52 radiates the heat of the refrigerant generated in the compressor 52 and discharges it into the drier 53.

The drier 53 removes humidity from the refrigerant passed the condenser 52 and discharges it into the three-way stepping motor valve 54.

The three-way stepping motor valve 54 discharges the refrigerant passed the direr 55 into the first and the second expansion valves 55, 56. Herein, the refrigerant passed the drier 53 is discharged into the first and the second expansion valves 55, 56 when the three-way stepping motor valve 54 is in an open state. Herein, the three-way stepping motor valve 54 is opened and shut according to the control signal of the microcomputer 63. Accordingly, the refrigerant passed the drier 53 is discharged into the first and the second expansion valves 55, 56 when only the three-way stepping motor valve 54 is in the open state. In more detail, the microcomputer 63 judges whether the freezing chamber or the chilling chamber requires cold air after comparing the temperature of the freezing chamber or the chilling chamber with the preset temperature. For example, when the freezing chamber requires the cold air, the microcomputer 63 controls the three-way stepping motor valve 54 so as to be the open state in order to supply the cold air to the freezing chamber. In more detail, when the three-way stepping motor valve 54 opens only the refrigerant pipe connected to the first expansion valve 55 according to the control signal of the microcomputer 63, the cold air is supplied to only the first evaporator 57 connected to the first expansion valve 55 through the refrigerant pipe.

On the contrary, when the three-way stepping motor valve 54 opens only the refrigerant pipe connected to the second expansion valve 56 according to the control signal of the microcomputer 63, the cold air is supplied to only the second evaporator 58 connected to the second expansion valve 56 through the refrigerant pipe.

Accordingly, the three-way stepping motor valve 54 discharges the refrigerant to the first expansion valve 55 or the second expansion valve 56 or both the first and the second expansion valves 55, 56 according to the control signal of the microcomputer 63.

The first and the second expansion valves 55, 56 depress the discharged high pressure refrigerant and adjusts it so as to be an evaporable state. Herein, the refrigerant passed the first 55 or the second expansion valve 56 evaporates at the first 57 or the second evaporator 58 by removing heat from the freezing chamber or the chilling chamber, accordingly the cold air is supplied to the freezing chamber and the chilling chamber.

Accordingly, the cold air is supplied to the freezing chamber or the chilling chamber by the first evaporator 57 or the second evaporator 58, the refrigerant in the vaporization state flows into the compressor 51 again, accordingly the refrigerating cycle is constructed. Herein, the refrigerant is transformed from the high temperature-high pressure state to the low temperature-low pressure state and to the high temperature-high pressure state again while circulating the refrigerating cycle. In more detail, in the refrigerating cycle constructed with the first and the second evaporators 57, 58, because the refrigerating cycle is constructed through the three-way stepping motor valve operating in the open state according to the control signal of the microcomputer 63, the refrigerating cycle is controlled differently according to the temperature of the freezing chamber and the chilling chamber.

For example, when the freezing chamber requires cold air, the refrigerating cycle operates (the refrigerant circulates) by opening the refrigerant pipe connecting the three-way stepping motor valve 54 and the first expansion valve 55. On the contrary, when the chilling chamber requires cold air, the refrigerating cycle operates (the refrigerant circulates) by opening the refrigerant pipe connecting the three-way stepping motor valve 54 and the second expansion valve 56. In addition, when all the refrigerant pipes connected to the first and the second expansion valves 55, 56 are opened, the refrigerating cycle operates.

On the contrary, when all the refrigerant pipes connected to the first and the second expansion valves 55, 56 are shut, the refrigerating cycle does not operate (the refrigerant does not circulate).

Hereinafter, the structure of the three-way stepping motor valve 54 will be described with reference to accompanying FIG. 6.

Figure 6:
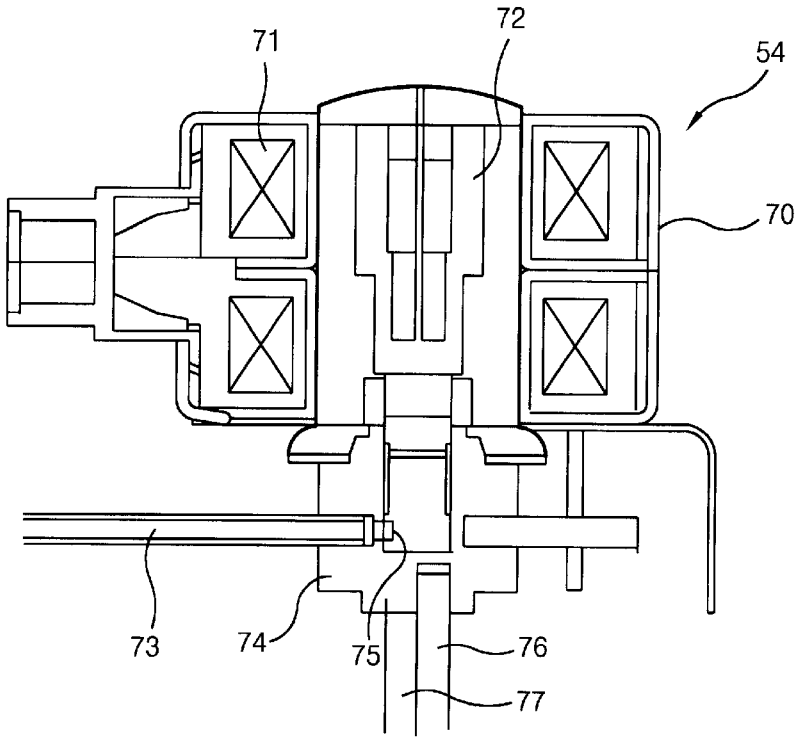
FIG. 6 is a sectional view illustrating a structure of a three-way stepping motor valve in accordance with the first embodiment of the present invention.

FIG. 6 is a sectional view illustrating a structure of a three-way stepping motor valve in accordance with the first embodiment of the present invention.

As depicted in FIG. 6, the three-way stepping motor valve 54 includes a motor unit 70 having a stator 71 and a rotator 72, a valve housing 74 installed at the lower portion of the motor unit 70, a valve shaft 75 installed inside the valve housing 74 and rotated by the rotator 72, a first and a second output ports 76, 77 installed at the valve housing 74, and an input port 73 installed at the valve shaft 75. In more detail, in the three-way stepping motor valve 54 and the rotator 72 rotates by an electromagnetic mutual interaction of the stator 71 and the rotator 72, the valve shaft 75 rotates by the rotation of the rotator 72 in order to open and shut the first and the second output ports 76, 77. The operation of the three-way stepping motor valve 54 will be described in detail with reference to accompanying FIGS. 7A~7D.

Figure 7A:
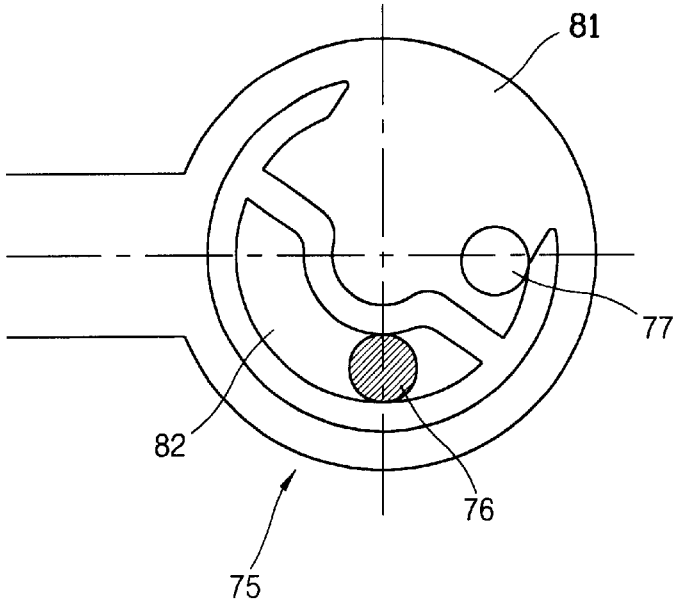
FIGS. 7A~7D are sectional views illustrating an operation of a three-way stepping motor valve in accordance with the first embodiment of the present invention.

FIGS. 7A~7D illustrate the operation principle of the three-way stepping motor valve according to the first embodiment of the present invention. In FIG. 7A, the first output port 76 is shut by a shut region 82 of the valve shaft 75 and the second output port 77 is opened by an open region 81 of the valve shaft 75 according to the rotation of the valve shaft 75.

Figure 7B:
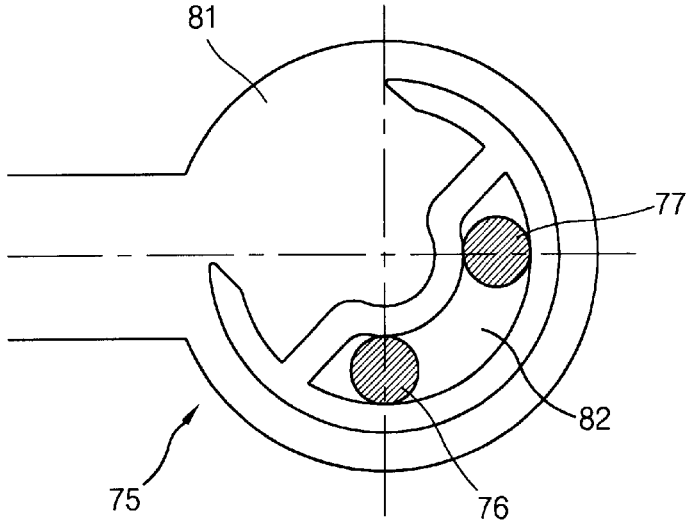

In FIG. 7B, the first and the second output ports 76, 77 are shut by the shut region 82 according to the rotation of the valve shaft 75. Herein, because the first and the second output ports 76, 77 are shut, the refrigerant can not be discharged into the first and the second expansion valves 61, 63.

Figure 7C:
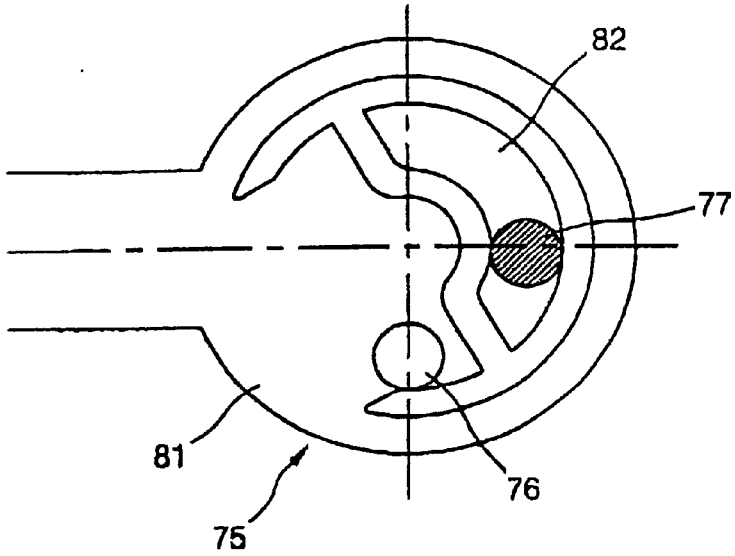

In FIG. 7C, the first output port 76 is open and the second output port 77 is shut by the rotation of the valve shaft 75. In more detail, according to the rotation of the valve shaft 75, the second output port 77 is shut by the shut region 82 and the first output port 76 is opened by the open region 81.

Figure 7D:
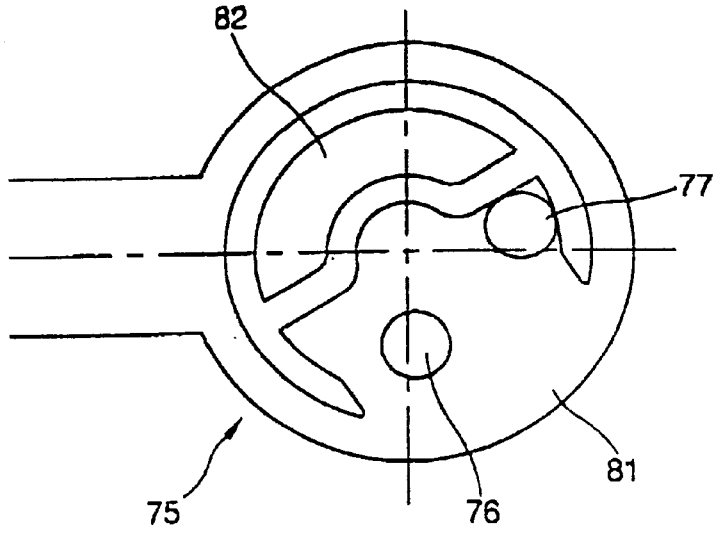

In FIG. 7D, according to the rotation of the valve shaft 75, the first and the second output ports 76, 77 are opened. In more detail, because both the first and the second output ports 76, 77 are connected to the open region 81 of the valve shaft 75, the refrigerant flowed into the valve housing 74 through the input port 73 is discharged into the first and the second output ports 76, 77.

Hereinafter, the operation of the three-way stepping motor valve will be described in detail with reference to accompanying FIGS. 7A~7D.

First, the valve shaft 75 has a cylindrical shape, and the open region 81 is formed at the side surface and some part of the lower portion of the valve shaft 75. In addition, the shut region 82 is formed at the rest of the lower surface. Herein, the shut region 82 shuts the first and the second output ports 76, 77, and the open region 81 opens the first and the second output ports 76, 77.

The input port 73, the first and the second output ports 76, 77 are connected to the valve housing 74. In more detail, the input port 73 is formed by penetrating the valve housing 74, and the refrigerant is discharged inside the valve housing 74 through the input port 73. In addition, the first and the second output ports 76, 77 are formed by separately penetrating the valve housing 74, and the refrigerant discharged inside the valve housing 74 is discharged into the first and the second output ports 76, 77. Herein, the first output port 76 opens on the refrigerant pipe connected to the first expansion valve 55 and the second output port 77 opens on the refrigerant pipe connected to the second expansion valve 56.

Hereinafter, the process for controlling the operation of the three-way stepping motor valve according to the first embodiment of the present invention will be described with reference to accompanying FIG. 8.

Figure 8:
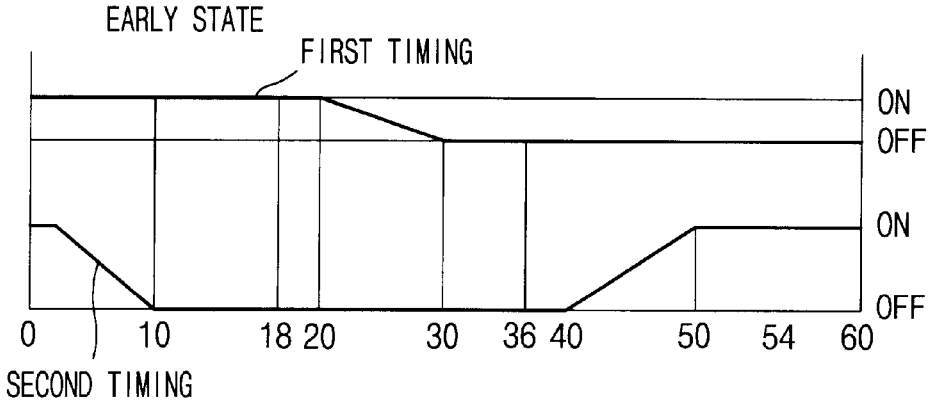
FIG. 8 is a timing chart illustrating operation of the three-way stepping motor valve in accordance with the first embodiment of the present invention.

FIG. 8 is a timing chart illustrating operation of the three-way stepping motor valve in accordance with the first embodiment of the present invention.

As depicted in FIG. 8, the three-way stepping motor valve 54 opens and shuts the refrigerant pipe connected to the first expansion valve 55 from step 0 to step 60 (a first timing). Herein, the step means a transferring distance or a transferring angle in which the rotor of the stepping motor 65 (the three-way stepping motor valve 54) is transferred from a south pole to a north pole or the north pole to the south pole inside of the stepping motor 65. In more detail, in regions of step 0~step 20 the refrigerant pipe connected to the first expansion valve 55 is opened. And, in step 30~step 60 the operation for shutting the refrigerant pipe connected to the first expansion valve 55 is performed. In addition, in step 30~step 60 the refrigerant pipe connected to the first expansion valve 55 is shut (a first timing).

On the contrary, the three-way stepping motor valve 54 shuts the refrigerant pipe connected to the second expansion valve 56 in step 0~step 60 (a second timing). In more detail, in a region of step 0, the refrigerant pipe connected to the second expansion valve 56 is opened. In regions of step 0~step 10, the operation for shutting the refrigerant pipe connected to the second expansion valve 56 is performed. In regions of step 10~step 40, the refrigerant connected to the second expansion valve 56 is opened. In addition, regions of step 40~step 50, the operation for opening the refrigerant pipe connected to the second expansion valve 56 is performed and in regions of step 50~step 60 the refrigerant pipe connected to the second expansion valve 56 is opened (the second timing).

The microcomputer 63 stores information related to the operation state of the refrigerant pipe connected to the first expansion valve 55 or the second expansion valve 56 according to each step in an internal memory 63B. In addition, in order to open and shut the two refrigerant pipes connected to the first and the second expansion valves 55, 56, the microcomputer 63 controls the three-way stepping motor valve 54 on the basis of information corresponded to each operation state stored in the memory 63B by a user's request or a self-control.

In the meantime, in order to control the operation of the three-way stepping motor valve 54 in an open state or a shut state, a present position of the three-way stepping motor valve 54 (the rotor of the stepping motor 65) has to be recognized. Accordingly, a process for adjusting the three-way stepping motor valve 54 so as to be in an early state is required before the refrigerant is discharged through one of the refrigerant pipe connecting the three-way stepping motor valve 54 and the first expansion valve 55 and the refrigerant pipe connecting the three-way stepping motor valve 54 and the second expansion valve 56. In more detail, before performing all control operations, the three-way stepping motor valve 54 (the rotor of the stepping motor 65) is adjusted so as to be in the early state and is adjusted according to a request angle or each step. It will be described in detail with reference to accompanying FIG. 9.

Figure 9:
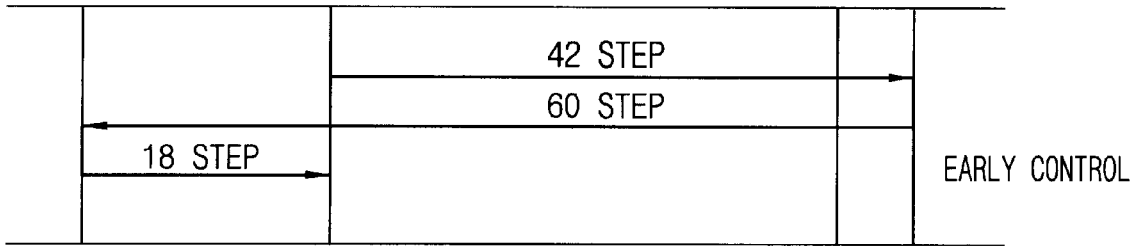
FIG. 9 is a first control diagram illustrating a method for controlling the three-way stepping motor valve in accordance with the first embodiment of the present invention.

FIG. 9 is a first control diagram illustrating a method for controlling the three-way stepping motor valve in accordance with the first embodiment of the present invention.

As depicted in FIG. 9, the early state is set as step 18, the rotor (not shown) of the stepping motor 65 is rotated in a certain direction to the utmost, is rotated again in the opposite direction to the utmost and is placed at a target initial position by the above-mentioned control. In more detail, the microcomputer 63 adjusts the rotor of the stepping motor 65 at the early state by rotating and reverse-rotating the stepping motor 65. For example, the stepping motor 65 rotates from the certain position to a position of step 42 according to the control signal of the microcomputer 63. Herein, when the stepping motor 65 does not rotate any more, the microcomputer 63 reverse-rotates the stepping motor 65 to a position of step 60, rotates the stepping motor 65 to a position of step 18 and sets the initial position of the stepping motor 65 (the rotor of the stepping motor 65). Herein, a maximum step of the stepping motor 65 is step 60. In other words, the stepping motor 65 can not rotate over step 60.

Hereinafter, another method for controlling the refrigerant inside the refrigerating cycle will be described in detail with reference to accompanying FIGS. 10 and 11.

Figure 10:
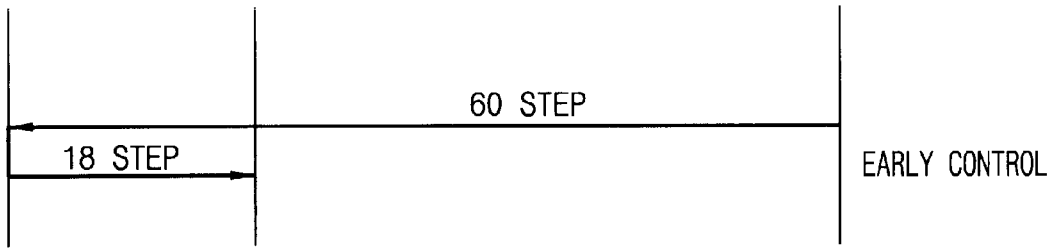
FIG. 10 is a second control diagram illustrating a method for controlling the three-way stepping motor valve in accordance with the first embodiment of the present invention.

FIG. 10 is a second control diagram illustrating a method for controlling the three-way stepping motor valve in accordance with the first embodiment of the present invention.

As depicted in FIG. 10, the rotor (not shown) inside the stepping motor valve 54 is rotated in a certain direction to the utmost (step 60), the target initial position (step 18) is set, the rotor of the stepping motor 65 is set at the initial position by controlling its rotation and reverse-rotation in a request direction according to the control signal of the microcomputer 63. It will be described with reference to accompanying FIG. 11.

Figure 11:
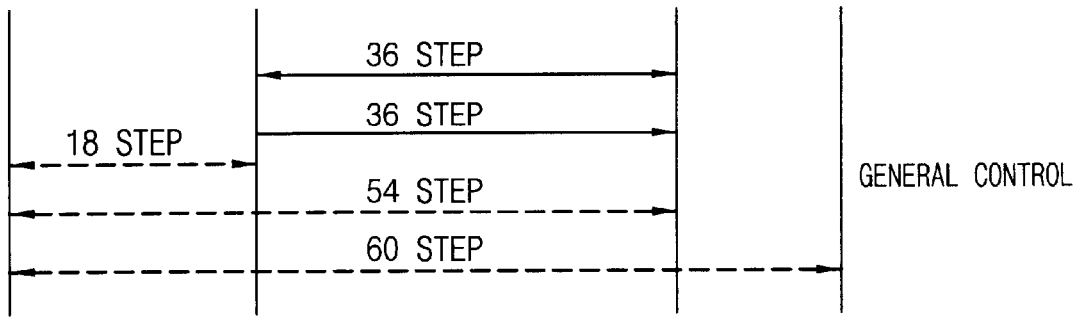
FIG. 11 is a control diagram illustrating a general stepping motor valve in order to compare it with the three-way stepping motor valve of FIG. 10.

FIG. 11 is a control diagram illustrating a general stepping motor valve in order to compare it with the three-way stepping motor valve of FIG. 10.

As depicted in FIG. 11, when step 60 is the maximum rotation region, because the general stepping motor rotates and reverse-rotates in step 18~step 54 (the total of 36 steps), the conventional microcomputer controls inaccurately the position of the rotor of the stepping motor. Accordingly, the microcomputer 63 in accordance with the present invention makes the rotor of the stepping motor 65 operate from the initial position always in order to control the position of the rotor of the stepping motor 65 accurately.

Figure 12:
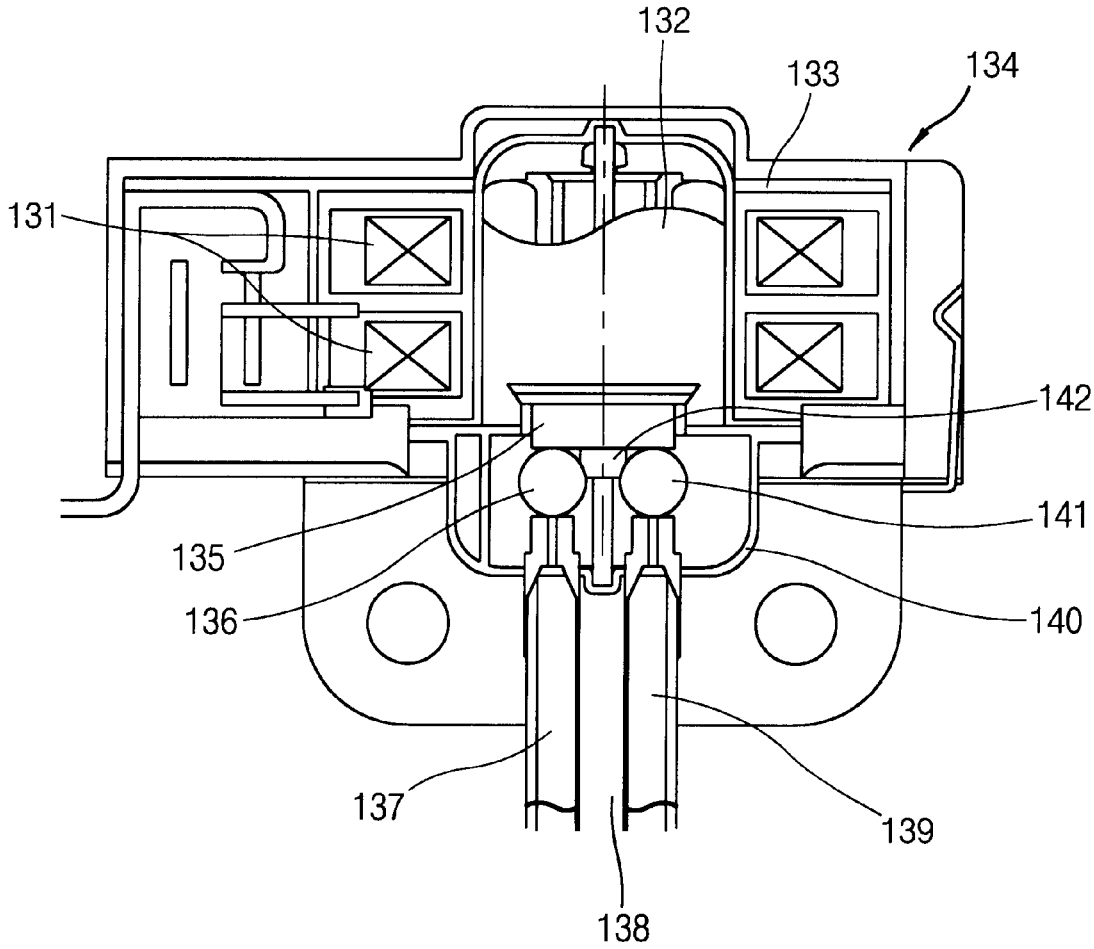
FIG. 12 is a sectional view illustrating a three-way stepping motor valve in accordance with the second embodiment of the present invention.

FIG. 12 is a sectional view illustrating a three-way stepping motor valve in accordance with the second embodiment of the present invention.

As depicted in FIG. 12, the three-way stepping motor valve according to the second embodiment of the present invention includes a motor unit 133 having a stator 131 and a rotator 132, a valve housing 140 installed at the lower portion of the motor unit 133, a valve shaft 135 installed inside the valve housing 140 and rotating by connecting to the rotator 132, and a rotor cam 142 installed at the lower end of the valve shaft 135. Herein, an input port 138, a first and a second output ports 137, 139 are separately formed at the lower portion of the valve housing 140 by penetrating it. The input port 138 is connected to the drier 53 side, and the first and the second output ports 137, 139 are separately connected to the refrigerant pipes connected to the first and the second expansion valves 55, 56. In addition, sealing balls 136, 141 opening and shutting the first and the second output ports 137, 139 are installed at the lower surface of the valve shaft 135. Positions of the sealing balls 136, 141 are installed by the rotor cam 142 of the valve shaft 135 and a guide unit (not shown) and the sealing balls 136, 141 opens and shuts the first and the second output ports 137, 139. Hereinafter, the operation principle of the three-way stepping motor valve according to the second embodiment of the present invention will be described in detail with reference to accompanying FIGS. 13A~13C.

Figure 13A:
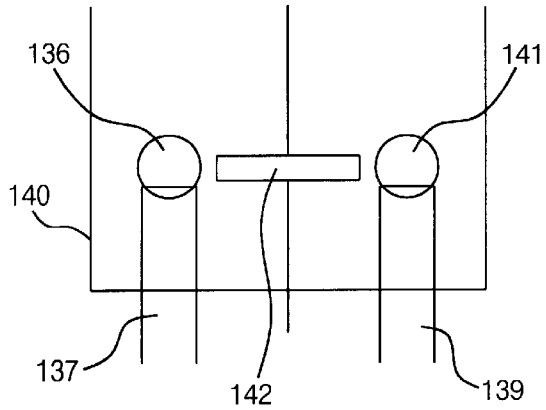
FIGS. 13A~13C are sectional views illustrating an operation of the three-way stepping motor valve in accordance with the second embodiment of the present invention.
Figure 13B:
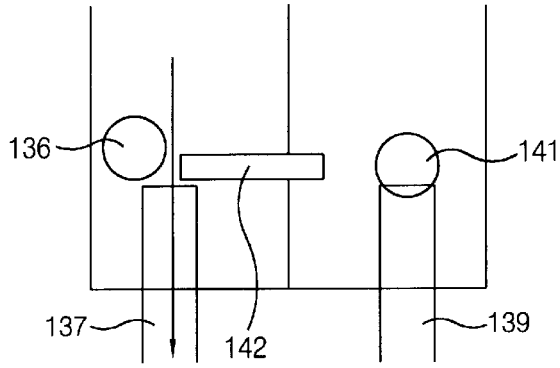
Figure 13C:
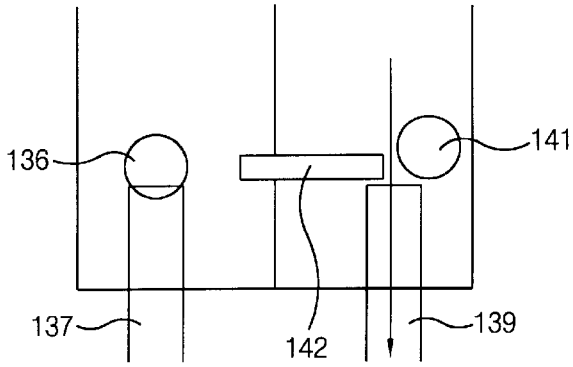

FIGS. 13A~13C are sectional views illustrating an operation of the three-way stepping motor valve in accordance with the second embodiment of the present invention.

In FIG. 13A, both the first and the second output ports 137, 139 are shut by the sealing balls 136, 141. In more detail, when both the first and the second output ports 137, 139 are shut by the sealing balls 136, 141, the valve shaft 135 rotates by the rotation of the rotator 132, as depicted in FIG. 13B, the sealing ball 136 is pushed by the rotor cam 142, and the first output port 137 is opened. Herein, the second output port 139 is still shut by the sealing ball 141.

After, when the rotator 132 rotates, as depicted in FIG. 13C, the first output port 137 is shut by the sealing ball 136, the sealing ball 141 is pushed by the rotor cam 142, and the second output port 139 is opened.

In the meantime, when both the first output port 137 and the second output port 139 are pushed by the rotor cam 142 at the same time, both the first output port 137 and the second output port 139 can be opened.

Hereinafter, the process for controlling the operation of the three-way stepping motor valve according to the second embodiment of the present invention will be described in detail with reference to accompanying FIG. 14.

Figure 14:
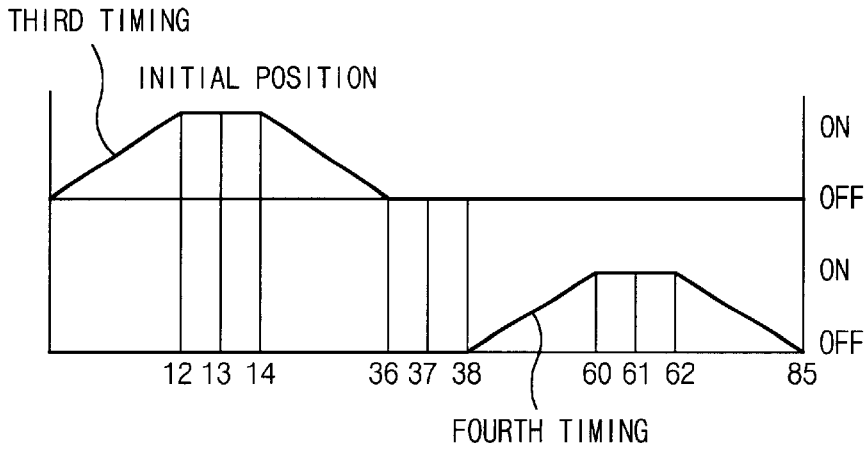
FIG. 14 is a timing chart illustrating a process for controlling operation of the three-way stepping motor valve in accordance with the second embodiment of the present invention.

FIG. 14 is a timing chart illustrating a process for controlling operation of the three-way stepping motor valve in accordance with the second embodiment of the present invention.

As depicted in FIG. 14, the three-way stepping motor valve 54 opens and shuts the refrigerant pipe connected to the first expansion valve 55 in step 0~step 85 (a third timing). In more detail, in regions of step 0~step 12, the operation for opening the refrigerant connected to the first expansion valve 55 is performed. In addition, regions of step 12~step 14, the refrigerant pipe connected to the first expansion valve 55 is opened. In addition, in regions from step 14~step 36, the operation for shutting the refrigerant pipe connected to the first expansion valve 55 is performed, and in regions from step 36~step 85 the refrigerant pipe connected to the first expansion valve 55 is shut (the third timing).

On the contrary, the three-way stepping motor valve 54 opens and shuts the refrigerant pipe connected to the second expansion valve 56 in step 0~step 85 (a fourth timing). In more detail, in regions from step 0~step 38, the refrigerant pipe connected to the second expansion valve 56 is shut. In regions from step 38~step 60, the operation for opening the refrigerant pipe connected to the second expansion valve 56 is performed. In regions from step 60~step 62, the refrigerant pipe connected to the second expansion valve 56 is opened. In addition, regions step 62~step 85, the operation for shutting the refrigerant pipe connected to the second expansion valve 56 is performed. Herein, the microcomputer 63 stores information corresponded to the operation state of the refrigerant pipe connected to the first expansion valve 55 or the second expansion valve 56 according to each region in the internal memory 63B.

After that, in order to open and shut the two refrigerant pipes connected to the first and the second expansion valves 55, 56 according to a user's request or a self-control, the microcomputer 63 controls the three-way stepping motor valve 54 on the basis of information corresponded to the operation state of each process stored in the memory 63B.

As described above, in order to control the three-way stepping motor valve so as to be in the open state or the shut state, a present position of the three-way stepping motor valve 54 (the rotor of the stepping motor 65) has to be recognized. Accordingly, a process for adjusting the three-way stepping motor valve 54 so as to be in an early state is required before the refrigerant is discharged through one of the refrigerant pipe connecting the three-way stepping motor valve 54 and the first expansion valve 55 and the refrigerant pipe connecting the three-way stepping motor valve 54 and the second expansion valve 56. In more detail, before performing all control operations, the three-way stepping motor valve 54 (the rotor of the stepping motor 65) is adjusted so as to be in the early state and is adjusted according to a request angle or each step. It will be described in detail with reference to accompanying FIG. 15.

Figure 15:
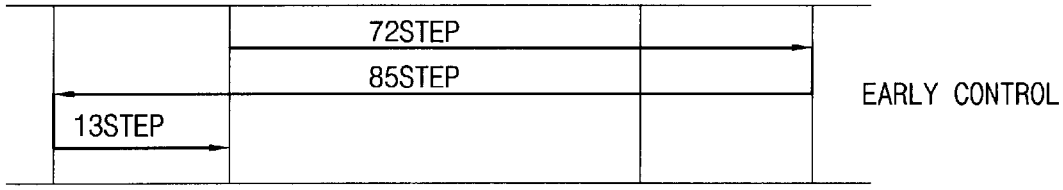
FIG. 15 is a first control diagram illustrating a method for controlling the three-way stepping motor valve in accordance with the second embodiment of the present invention.

FIG. 15 is a first control diagram illustrating a method for controlling the three-way stepping motor valve in accordance with the second embodiment of the present invention.

As depicted in FIG. 15, the early state is set as step 13, the rotor (not shown) of the stepping motor 65 is rotated in a certain direction to the utmost, is rotated again in the opposite direction to the utmost and is placed at a target initial position by the above-mentioned control. In more detail, the microcomputer 63 adjusts the rotor of the stepping motor 65 at the early state by rotating and reverse-rotating the stepping motor 65. For example, the stepping motor 65 rotates from the certain position to a position of step 72 according to the control signal of the microcomputer 63. Herein, when the stepping motor 65 does not rotate any more, the microcomputer 63 reverse-rotates the stepping motor 65 to a position of step 85, rotates the stepping motor 65 to a position of step 13 and sets the initial position of the stepping motor 65 (the rotor of the stepping motor 65). Herein, a maximum step of the stepping motor 65 is step 85.

Hereinafter, a method for controlling the three-way stepping motor valve according to the second embodiment of the present invention will be described in detail with reference to accompanying FIG. 16.

Figure 16:
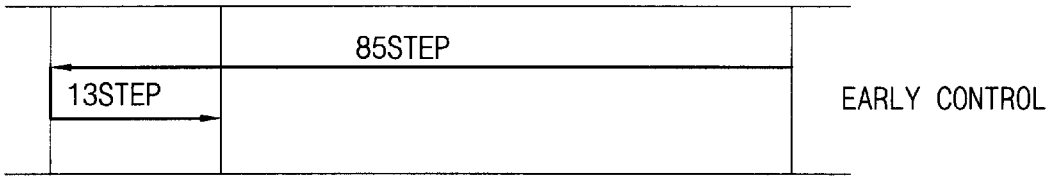
FIG. 16 is a second control diagram illustrating a method for controlling the three-way stepping motor valve in accordance with the second embodiment of the present invention.

FIG. 16 is a second control diagram illustrating a method for controlling the three-way stepping motor valve in accordance with the second embodiment of the present invention.

As depicted in FIG. 16, the rotor inside the three-way stepping motor valve 54 (rotor of the stepping motor 65) is rotated as step 85 (the maximum rotative state), a target initial position (step 13) is set, the rotor of the stepping motor 65 is rotated, is reverse-rotated according to the control signal of the microcomputer 63 in order to be placed at the initial position.

Figure 17:
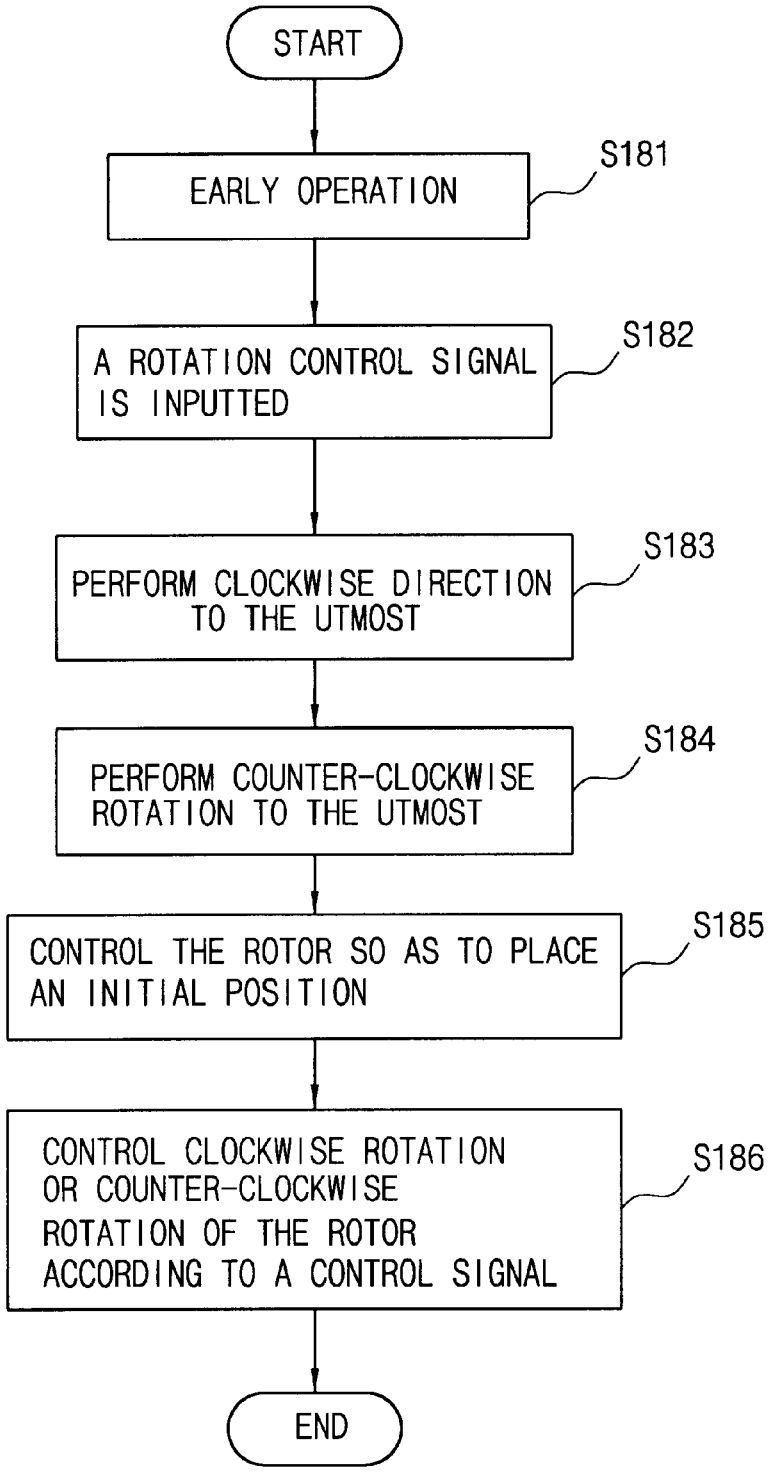
FIG. 17 is a flow chart illustrating a refrigerating cycle of a refrigerator in accordance with the second embodiment of the present invention.

FIG. 17 is a flow chart illustrating a refrigerating cycle of a refrigerator in accordance with the second embodiment of the present invention.

First, when power is applied to the refrigerator (at an early operation state) as shown at step S181, the microcomputer 63 checks whether a signal for rotating or reverse-rotating the rotor of the stepping motor 65 is inputted.

After, in order to circulate the refrigerant inside a certain refrigerant cycle, when the signal corresponded to the step S181 (information corresponded to an operation state stored in the memory 63B) is inputted as show at step S182, the rotor is rotated in a certain direction to the utmost as shown at step S183 before the rotor inside the three-way stepping motor valve 54 is rotated or reverse-rotated according to the signal.

After that, after rotating the rotor inside the three-way stepping motor valve 54 in a different direction to the utmost as shown at step S184, the rotor is fixed to a position set according to the initial position value (step 18) as shown at step S185. Herein, the rotor is controlled so as to place at the initial position (step 18) regardless of its former operation state.

The microcomputer 63 adjusts the position of the rotor by controlling the rotation of the rotor according to a rotation value and a rotation direction of the rotor as shown at step S186. Herein, the rotor inside the three-way stepping motor valve 54 has one state of FIGS. 7A~7D, the refrigerant circulates through the refrigerant pipe opened according to the position of the rotor.

Hereinafter, the structure of the refrigerating cycle according to the second embodiment of the present invention will now be described in detail with reference to accompanying FIG. 18.

Figure 18:
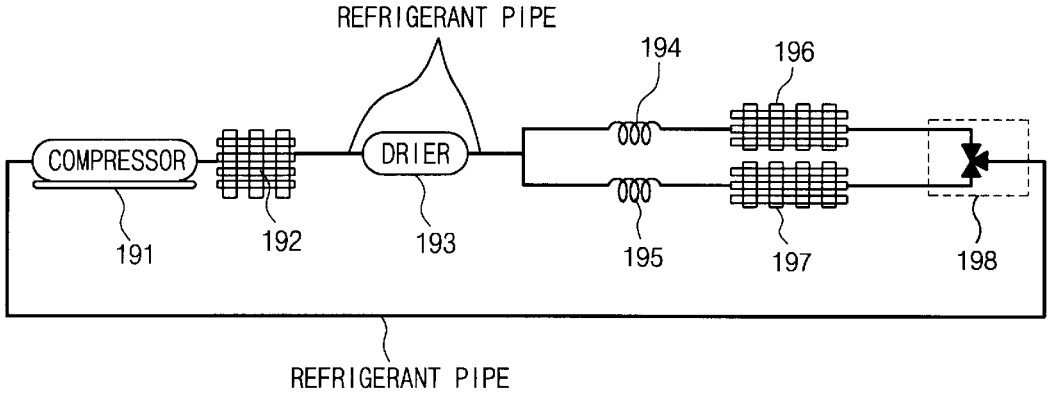
FIG. 18 is a block diagram illustrating a pressure state inside a refrigerating cycle of a refrigerator in accordance with the second embodiment of the present invention.

FIG. 18 is a block diagram illustrating a refrigerating cycle of a refrigerator in accordance with the second embodiment of the present invention.

As depicted in FIG. 18, the refrigerator in accordance with the second embodiment of the present invention includes a compressor 191 compressing a refrigerant, a condenser 192 radiating heat of the refrigerant compressed in the compressor 191, a drier 193 connected to the condenser 182 and removing heat from the refrigerant discharged from the condenser 192, a first and a second expansion valves 194, 195 connected to the drier 193 through the refrigerant pipe, separately supplied the refrigerant discharged from the drier 193 and depressing the supplied refrigerant, a first and a second evaporators 196, 197 separately connected to the first and the second expansion valves 194, 195 and generating cold air in order to absorb heat included in a foodstuff preserved in the freezing chamber or the chilling chamber by being supplied the depressed refrigerant, and a three-way stepping motor valve 198 separately connected to the first and the second evaporators 196, 197 and passing or shutting the refrigerant discharged from the first and the second evaporators 196, 197 according to the control signal of the microcomputer 63.

In more detail, in the refrigerator in accordance with the second embodiment of the present invention, by connecting the three-way stepping motor valve 198 and the compressor 191 directly through the refrigerant pipe, when the compressor 191 is in a pause state, the operation of the refrigerating cycle is stopped by operating the three-way stepping motor valve 198 as an off state (shut) (the refrigerant inside the refrigerating cycle is totally shut). It will now be described in detail with reference to accompanying FIG. 19.

Figure 19:
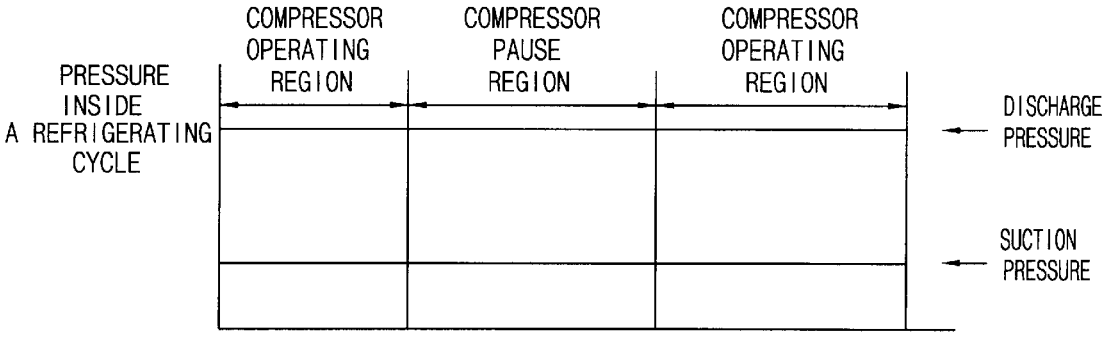
FIG. 19 is a chart illustrating a process for controlling a refrigerating cycle of a refrigerator in accordance with the second embodiment of the present invention.

FIG. 19 is a chart illustrating a process for controlling a refrigerating cycle of a refrigerator in accordance with the second embodiment of the present invention.

As depicted in FIG. 19, in a compressor 191 operation region and a compressor 191 pause region, a discharge pressure and a suction pressure of the compressor 191 are maintained always as the same state. Accordingly, the refrigerant inside the refrigerating cycle is in an optimum pressure state at the same time the compressor 191 is re-operated. In more detail, because a refrigerating efficiency of the refrigerant is heightened, a quantity of power consumption of the three-way stepping motor can be improved (for example, by about 70%).

In the meantime, in the pause region of the compressor 191, the refrigerant can not circulate in the refrigerating cycle, a noise due to the circulation of the refrigerant and a heat expansion noise do not occur. In more detail, when the compressor 191 is in the off state, the three-way stepping motor valve 198 is controlled so as to be in the off state, the noise caused by the circulation of the refrigerant is restrained.

Accordingly, in the first and the second embodiments of the present invention, the flow of the coolant inside the refrigerating cycle can be controlled by using the three-way stepping motor valve 198 of the refrigerator using the a plurality of evaporators. In more detail, by controlling opening and shutting of the three-way stepping motor valve 198 according to the rotation of the rotor inside the three-way stepping motor valve 198 in the present invention, a noise occurred in transferring of the conventional plunger can be restrained.

In addition, in the first and the second embodiments of the present invention, by using the three-way stepping motor valve, power consumption can be reduced (for example, reduced by greater than 9 watt~14 watt) in comparison with using the conventional two-way valve.

In addition, in the first and the second embodiments of the present invention, by using the three-way stepping motor valve, a wiring according to the conventional valve control can be reduced, weld zones according to the wiring can be reduced, and a production cost can be reduced.

Hereinafter, a refrigerating cycle of a refrigerator according to the third embodiment of the present invention will be described in detail with reference to accompanying FIG. 20.

Figure 20:
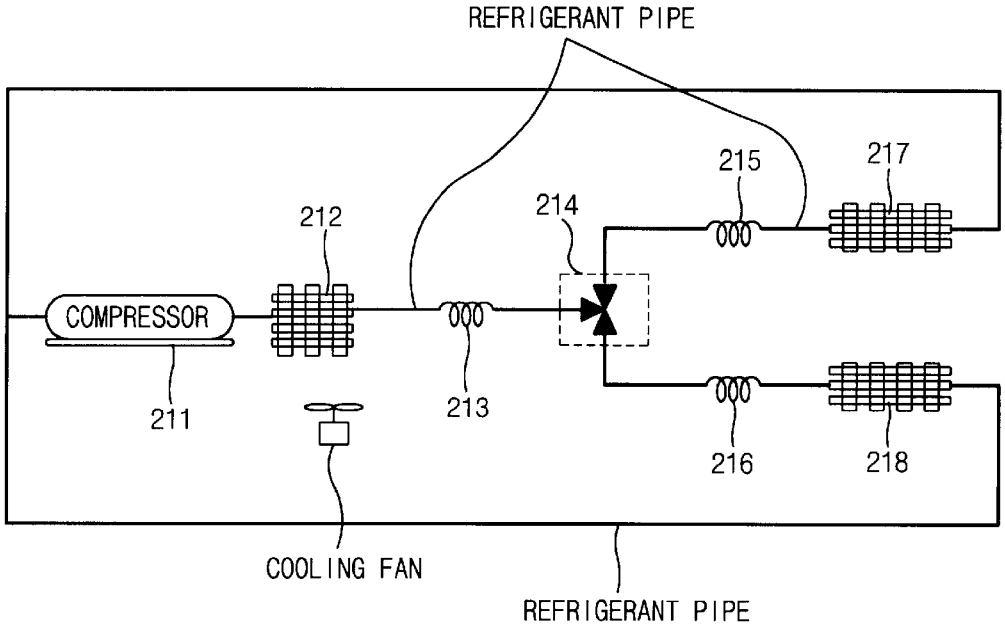
FIG. 20 is a block diagram illustrating a refrigerating cycle of a refrigerator in accordance with a third embodiment of the present invention.

FIG. 20 is a block diagram illustrating a refrigerating cycle of a refrigerator in accordance with a third embodiment of the present invention.

As depicted in FIG. 20, the refrigerator according to the third embodiment of the present invention includes a compressor 211 compressing a low pressure refrigerant, a condenser 212 condensing and liquefying the refrigerant compressed in the compressor 211, a first expansion valve 213 connected to the condenser 212 and depressing the refrigerant discharged from the condenser 212, a three-way stepping motor valve 214 passing or shutting the refrigerant discharged from the first expansion valve 213 according to the control signal from the microcomputer 63, a second and a third expansion valves 215, 216 separately connected to the three-way stepping motor valve 214 through the refrigerant pipe and depressing the refrigerant discharged from the three-way stepping motor valve 214, and first and a second evaporators 217, 218 being supplied the depressed refrigerant discharged from the second and the third expansion valves 215, 216 and generating cold air for absorbing heat from a foodstuff preserved in the freezing chamber and the chilling chamber. Herein, the first and the second evaporators 217, 218 are connected to the compressor 211 through the refrigerant pipe. In more detail, the refrigerating cycle of the refrigerator according to the third embodiment of the present invention is constructed in the order of the compressor 211→the condenser 212→the first expansion valve 213→the second and the third expansion valves 215, 216→the first and the second evaporators 217, 218→the compressor 211.

As depicted in FIG. 20, in the refrigerator including the plurality of evaporators 217, 218, according to on or off operation (opening or shutting) of the three-way stepping motor valve 214, the refrigerating cycle is constructed in the order of the the compressor 211→the condenser 212→the first expansion valve 213→the second expansion valve 215→the first evaporator 217→the compressor 211 or the refrigerating cycle is constructed in the order of the compressor 211→the condenser 212→the first expansion valve 213→the second and the third expansion valves 215, 216→the first and the second evaporators 217, 218→the compressor 211. Herein, the first expansion valve 213 is installed at the front end of the three-way steeping motor valve 214. In more detail, the first expansion valve 213 facilitates switching of the three-way stepping motor valve 214 by decreasing the pressure of the refrigerant supplied to the inlet of the three-way stepping motor valve 214. Herein, a plurality of first expansion valves can be installed.

Hereinafter, the operation of the refrigerator according to the third embodiment of the present invention will be described in detail.

First, when the cold air is required in the freezing chamber or the chilling chamber, the microcomputer 63 operates the refrigerating cycle by driving the compressor 211.

The compressor 211 is driven by the control signal of the microcomputer 63 and generates a high temperature-high pressure refrigerant. Herein, the high pressure-high temperature refrigerant generated in the compressor 211 is discharged into the condenser 212 through the refrigerant pipe.

The condenser 212 condenses and liquefies the refrigerant discharged from the compressor 211. Herein, the refrigerant flowed into the condenser 212 radiates heat and condenses. The refrigerant passed through the condenser 212 is discharged into the first expansion valve 214.

The first expansion valve 213 depresses the high pressure refrigerant passed through the condenser 212. Herein, the refrigerant depressed by the first expansion valve 213 is discharged into the three-way stepping motor valve 214. Herein, because the depressed refrigerant flows into the three-way stepping motor valve 214, the three-way stepping motor valve 214 can perform switching operation easily. In more detail, the output port of the three-way stepping motor valve 214 is opened and shut by the rotation of the valve shaft 75. When the refrigerant pressure of the input port of the three-way stepping motor valve 214 is high, because the pressure works on the valve shaft 75 as a load, it is difficult or impossible to perform switching of the three-way stepping motor valve 214 for opening and shutting the output port.

Accordingly, by flowing the refrigerant depressed by the first expansion valve 213 into the three-way stepping motor valve 214, the load pressure on the valve shaft 75 is decreased and the switching of the three-way stepping motor valve 214 is performed normally and easily.

After, the refrigerant depressed through the first expansion valve 213 is discharged into the second and the third expansion valves 215, 216 when the three-way stepping motor valve 214 is in the open state. Herein, the three-way stepping motor valve 214 is opened and shut according to the control signal of the microcomputer 63.

When the cold air is required only in the chilling chamber, the microcomputer 63 opens the output port of the three-way stepping motor valve 214 connected to the refrigerant pipe connected to the second expansion valve 215 in order to supply the cold air only to the chilling chamber.

On the contrary, when the cold air is required only in the freezing chamber, the microcomputer 63 opens the output port of the three-way stepping motor valve 214 connected to the refrigerant pipe connected to the third expansion valve 216 in order to supply the cold air only to the freezing chamber. In addition, when the cold air is required in both the chilling chamber and the freezing chamber, the microcomputer 63 opens the output port of the three-way stepping motor valve 214 connected to the refrigerant pipes separately connected to the second and the third expansion valves 215, 216 in order to supply the cold air to both the chilling chamber and the freezing chamber.

In the meantime, in the refrigerating cycle supplying the cold to only the chilling chamber, in order to switch it into the refrigerating cycle supplying the cold air to the freezing chamber, the microcomputer 63 outputs a valve switch order signal to a valve switching driving unit (not shown). The valve switching driving unit controls the stepping motor 65 by being inputted the valve switching order signal. The steeping motor 65 opens only the output port of the three-way stepping motor valve 214 connected to the refrigerant pipe connecting the third expansion valve 216 in order to supply the cold air to only the freezing chamber. Herein, the three-way stepping motor valve 214 is switched by the rotation of the valve shaft 75.

As described above, because the refrigerant depressed through the first expansion valve 213 flows into the input port of the three-way stepping motor valve 214, the three-way stepping motor valve 214 driven according to the control signal of the microcomputer 63 operates normally.

After that, the refrigerant passed through the three-way stepping motor valve 214 is discharged into the second and the third expansion valves 215, 216.

The second and the third expansion valves 215, 216 depress the refrigerant flowed from the three-way stepping motor valve 214 so as to make the refrigerant evaporate easily in the first and the second evaporators 217, 218 and discharge the depressed refrigerant into the first and the second evaporators 217, 218.

The first and the second evaporators 217, 218 are supplied the refrigerant discharged from the second and the third expansion valves 215, 216 and supply the cold air to the freezing chamber or the chilling chamber. Herein, the refrigerant flowed into the first and the second evaporators 217, 218 evaporates by the heat exchange between the outside.

Accordingly, in the refrigerator in accordance with the third embodiment of the present invention, in order to reduce the refrigerant pressure at the inlet side of the three-way stepping motor valve 214, an expansion valve is installed at the inlet side of the three-way stepping motor valve 214 in order to depress the refrigerant, accordingly the refrigerator can operate normally by switching the three-way stepping motor valve 214 easily.

Hereinafter, a refrigerating cycle of a refrigerator according to a fourth embodiment of the present invention will be described with reference to accompanying FIG. 21.

Figure 21:
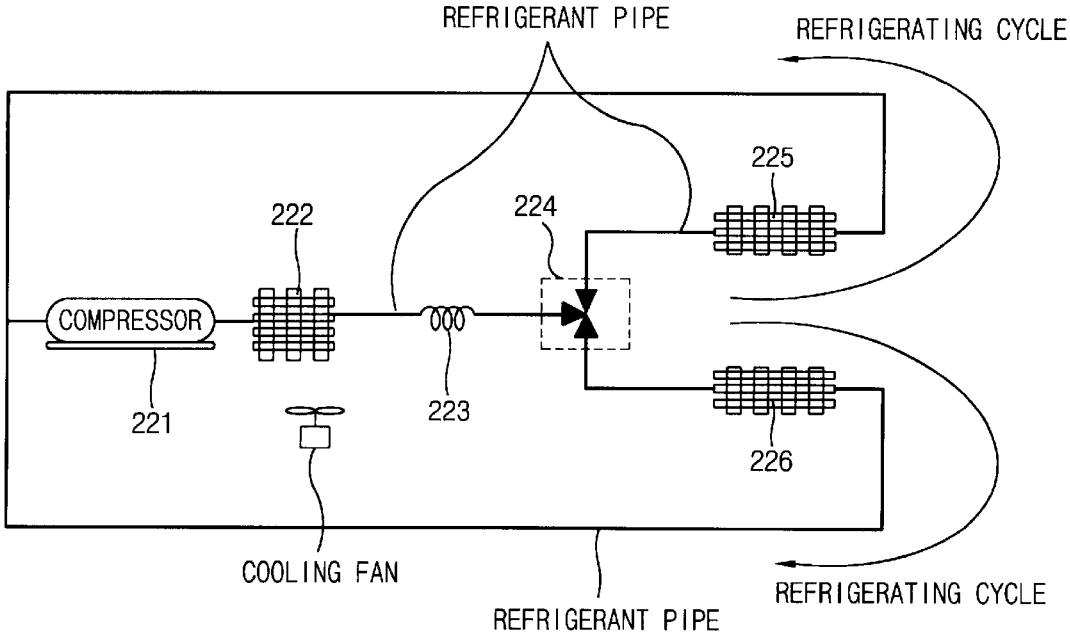
FIG. 21 is a block diagram illustrating a refrigerating cycle of a refrigerator in accordance with a fourth embodiment of the present invention.

FIG. 21 is a block diagram illustrating a refrigerating cycle of a refrigerator in accordance with a fourth embodiment of the present invention.

As depicted in FIG. 21, the refrigerating cycle of the refrigerator in accordance with a fourth embodiment of the present invention includes a compressor 221 compressing a low pressure refrigerant, a condenser 222 condensing and liquefying the refrigerant compressed in the compressor 221, an expansion valve 223 connected to the condenser 222 and depressing the refrigerant discharged from the condenser 222, a three-way stepping motor valve 224 passing or shutting the refrigerant discharged from the expansion valve 223 according to the control signal from the microcomputer 63, and a first and a second evaporators 225, 226 separately connected to the three-way stepping motor valve 224 and generating cold air for absorbing heat from a foodstuff preserved in the freezing chamber and the chilling chamber by being supplied the refrigerant discharged from the three-way stepping motor valve 224. Herein, the first and the second evaporators 225, 226 are connected to the compressor 221 through the refrigerant pipe. In more detail, the refrigerating cycle of the refrigerator according to the fourth embodiment of the present invention is constructed in the order of the compressor 221→the condenser 222→the expansion valve 223→the first and the second evaporators 225, 226→the compressor 221.

As depicted in FIG. 21, in the refrigerator including the plurality of evaporators 225, 226, according to on or off operation (opening or shutting) of the three-way stepping motor valve 224, the refrigerating cycle (a first refrigerating cycle) is constructed in the order of the compressor 221→the condenser 222→the expansion valve 223→the first evaporator 225→the compressor 221 or the refrigerating cycle (a second refrigerating cycle) is constructed in the order of the compressor 221→the condenser 222→the expansion valve 223→the second evaporator 226→the compressor 221 or the refrigerating cycle (a third refrigerating cycle) is constructed in the order of the compressor 221→the condenser 222→the expansion valve 223→the first and the second evaporator 225, 226→the compressor 221. Herein, the expansion valve 223 is installed at the front end of the three-way steeping motor valve 224 in order to depress the pressure of the refrigerant flowing into the inlet of the three-way stepping motor valve 224. In more detail, the expansion valve 223 facilitates switching of the three-way stepping motor valve 224 by reducing the pressure of the refrigerant supplied to the inlet of the three-way stepping motor valve 224. Herein, a plurality of expansion valves can be installed.

Hereinafter, the operation of the refrigerator in accordance with the fourth embodiment of the present invention will b described in detail.

First, when the cold air is required in the freezing chamber or the chilling chamber, the microcomputer 63 operates the refrigerating cycle by driving the compressor 221.

The compressor 221 is driven by the control signal of the microcomputer 63 and generates a high temperature-high pressure refrigerant. Herein, the high pressure-high temperature refrigerant generated in the compressor 221 is discharged into the condenser 222 through the refrigerant pipe.

The condenser 222 condenses and liquefies the refrigerant discharged from the compressor 221. Herein, the refrigerant flowed into the condenser 222 radiates heat and condenses. The refrigerant passed through the condenser 222 is discharged into the expansion valve 223.

The expansion valve 223 depresses the high pressure refrigerant passed through the condenser 222. Herein, the refrigerant depressed by the expansion valve 223 is discharged into the three-way stepping motor valve 224. Herein, because the depressed refrigerant flows into the three-way stepping motor valve 224, the three-way stepping motor valve 224 can perform switching operation easily. In more detail, the output port of the three-way stepping motor valve 224 is opened and shut by the rotation of the valve shaft 75. When the refrigerant pressure of the input port of the three-way stepping motor valve 224 is high, because the pressure works on the valve shaft 75 as a load, it is difficult or impossible to perform switching of the three-way stepping motor valve 224 for opening and shutting the output port.

Accordingly, by flowing the refrigerant depressed by the expansion valve 223 into the three-way stepping motor valve 224, the load pressure on the valve shaft 75 is decreased and the switching of the three-way stepping motor valve 224 is performed normally and easily.

After, the refrigerant depressed through the expansion valve 223 is discharged into the first and the second evaporators 225, 226 when the three-way stepping motor valve 224 is in the open state. Herein, the three-way stepping motor valve 224 is opened and shut according to the control signal of the microcomputer 63.

When the cold air is required only in the chilling chamber, the microcomputer 63 opens the output port of the three-way stepping motor valve 224 connected to the refrigerant pipe connected to the first evaporator 225 in order to supply the cold air only to the chilling chamber.

On the contrary, when the cold air is required only in the freezing chamber, the microcomputer 63 opens the output port of the three-way stepping motor valve 224 connected to the refrigerant pipe connected to the second evaporator 226 in order to supply the cold air only to the freezing chamber. In addition, when the cold air is required in both the chilling chamber and the freezing chamber, the microcomputer 63 opens the output port of the three-way stepping motor valve 224 connected to the refrigerant pipes separately connected to the first and the second evaporators 225, 226 in order to supply the cold air to both the chilling chamber and the freezing chamber.

In the meantime, in the refrigerating cycle supplying the cold to only the chilling chamber, in order to switch it into the refrigerating cycle supplying the cold air to the freezing chamber, the microcomputer 63 outputs a valve switch order signal to a valve switching driving unit (not shown). The valve switching driving unit controls the stepping motor 65 by being inputted the valve switching order signal. The steeping motor 65 opens only the output port of the three-way stepping motor valve 224 connected to the refrigerant pipe connecting the second evaporator 226 in order to supply the cold air to only the freezing chamber. Herein, the three-way stepping motor valve 224 is switched by the rotation of the valve shaft 75.

As described above, because the refrigerant depressed through the expansion valve 223 flows into the input port of the three-way stepping motor valve 224, the three-way stepping motor valve 224 driven according to the control signal of the microcomputer 63 operates normally.

In the meantime, in order to make the refrigerant passed through the condenser 222 evaporate easily, the refrigerant has to flow into the first and the second evaporators 225, 226 in the depressed state, in the third embodiment of the present invention the expansion valves 215, 216 are installed at the front end of the evaporators 217, 218, however in the fourth embodiment of the present invention the expansion valve 223 is installed only at the front end of the three-way stepping motor valve 224 without installing the expansion valves 215, 216 at the front end of the first and the second evaporators 225, 226, accordingly the pressure of the refrigerant flowing into the three-way stepping motor valve 224 is reduced and at the same time the refrigerant flowing into the three-way stepping motor valve 224 evaporates easily and quickly in the first and the second evaporators 225, 226. In more detail, with one expansion valve 223 installed at the front end of the three-way stepping motor valve 224 the switching of the three-way stepping motor valve 224 can be performed normally and the first and the second evaporators can easily evaporate the flowing refrigerant.

The first and the second evaporators 225, 226 supply the cold air o the freezing chamber or the chilling chamber by being supplied the refrigerant discharged form the three-way steeping motor valve 224. Herein, the first and the second evaporators 225, 226 evaporate (liquid into gas) by the heat exchange between the outside.

Accordingly, in the refrigerator in accordance with the fourth embodiment of the present invention, in order to reduce the refrigerant pressure at the inlet side of the three-way stepping motor valve 224, the expansion valve is installed at the inlet side of the three-way stepping motor valve 224 in order to depress the refrigerant, accordingly the refrigerator can operate normally by switching the three-way stepping motor valve 224 easily. In addition, a production cost can be reduced without installing the expansion valve at the front end of the first and the second evaporators 225, 226.

Hereinafter, an apparatus for controlling a refrigerating cycle of a refrigerator in accordance with the present invention will now be described with reference to the accompanying FIGS. 21 and 22.

Figure 22:
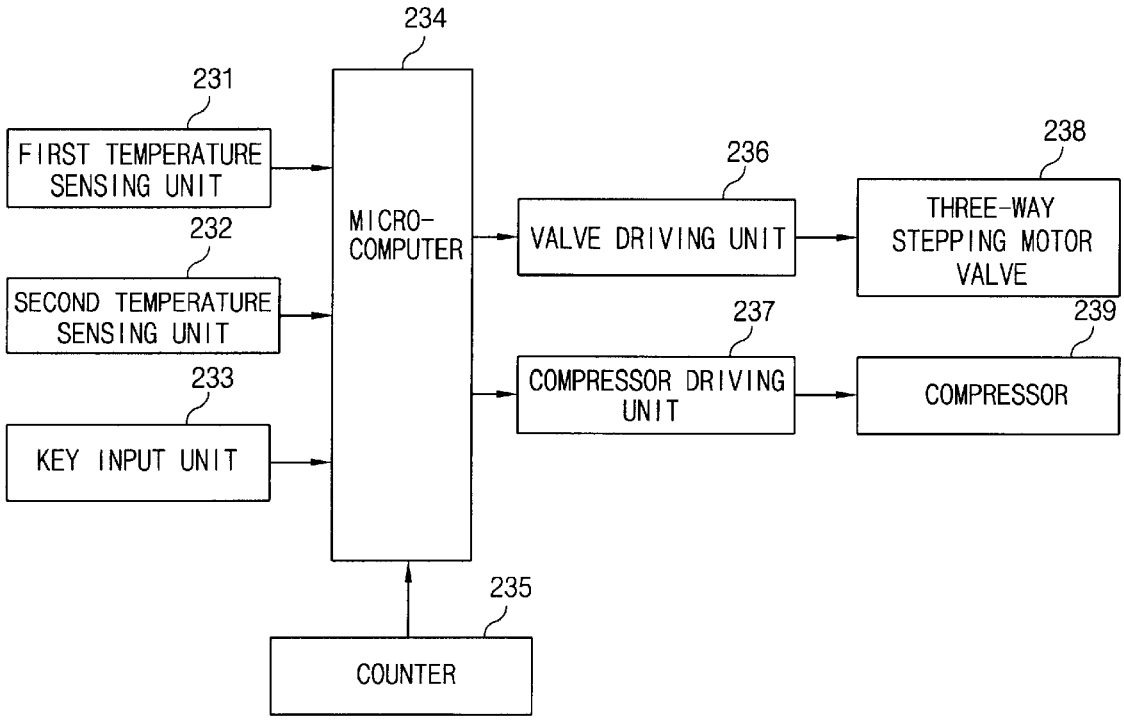
FIG. 22 is a block diagram illustrating an apparatus for controlling a refrigerating cycle of a refrigerator in accordance with the fourth embodiment of the present invention.

FIG. 22 is a block diagram illustrating an apparatus for controlling a refrigerating cycle of a refrigerator in accordance with a fourth embodiment of the present invention.

As depicted in FIG. 22, the apparatus for controlling the refrigerating cycle of the refrigerator in accordance with the fourth embodiment of the present invention includes a first temperature sensing unit 231 sensing a temperature of the freezing chamber and generating a first sensing signal for operating the refrigerating cycle of the freezing chamber, a second temperature sensing unit 232 sensing a temperature of the chilling chamber and generating a second sensing signal for operating the refrigerating cycle of the chilling chamber, a compressor 239 sucking cold air evaporated in the plurality of evaporators 225, 226 and generating a high pressure-high temperature refrigerant by compressing the cold air, a compressor driving unit 237 controlling he operation of the compressor 239, a three-way stepping motor valve 238 passing or shutting the refrigerant in order to supply the refrigerant generated in the compressor 239 to the freezing chamber and the chilling chamber through the refrigerant pipe, a valve driving unit 236 controlling the operation of the three-way stepping motor valve 238, a counter counting an early refrigerating time according to the early operation of the compressor 235, a microcomputer 234 switching the three-way stepping motor valve 238 when the counted early refrigerating time exceeds a preset time, and a signal input unit 233 outputting various signals to the microcomputer 234 according to a set of a user. Herein, in the early operation of the refrigerating cycle, the microcomputer waits 234 until the early refrigerating time exceeds the preset time without switching the three-way stepping motor valve 125 instantly in order to supply the cold air to the freezing chamber or the chilling chamber.

After, when the early refrigerating time exceeds the preset time, the microcomputer 234 switches the three-way stepping motor valve 238. In addition, after the refrigerating cycles of the freezing chamber and the chilling chamber arrive to a cycle balance, the microcomputer 234 judges whether cold air is required in the freezing chamber and the chilling chamber on the basis of the temperature sensed in the first temperature sensing unit 231 and the second temperature sensing unit 232, the first and the second sensing signals. When it is judged the cold air is required in the freezing chamber, the microcomputer 234 opens the three-way stepping motor valve 238 in order to supply the refrigerant to the refrigerating cycle of the freezing chamber.

On the contrary, when it is judged the cold air is required in the freezing chamber, the microcomputer 234 opens the three-way stepping motor valve 238 in order to supply the cold air to the refrigerating cycle of the chilling chamber. Herein, when the three-way stepping moor valve 238 is opened, the refrigerant can be supplied to the freezing chamber or the chilling chamber, when the three-way stepping motor valve 238 is shut, the refrigerant can not be supplied to the freezing chamber or the chilling chamber.

Hereinafter, the operation of the apparatus for controlling the refrigerating cycle of the refrigerator in accordance with the present invention will now be described with reference to the accompanying FIG. 23.

Figure 23:
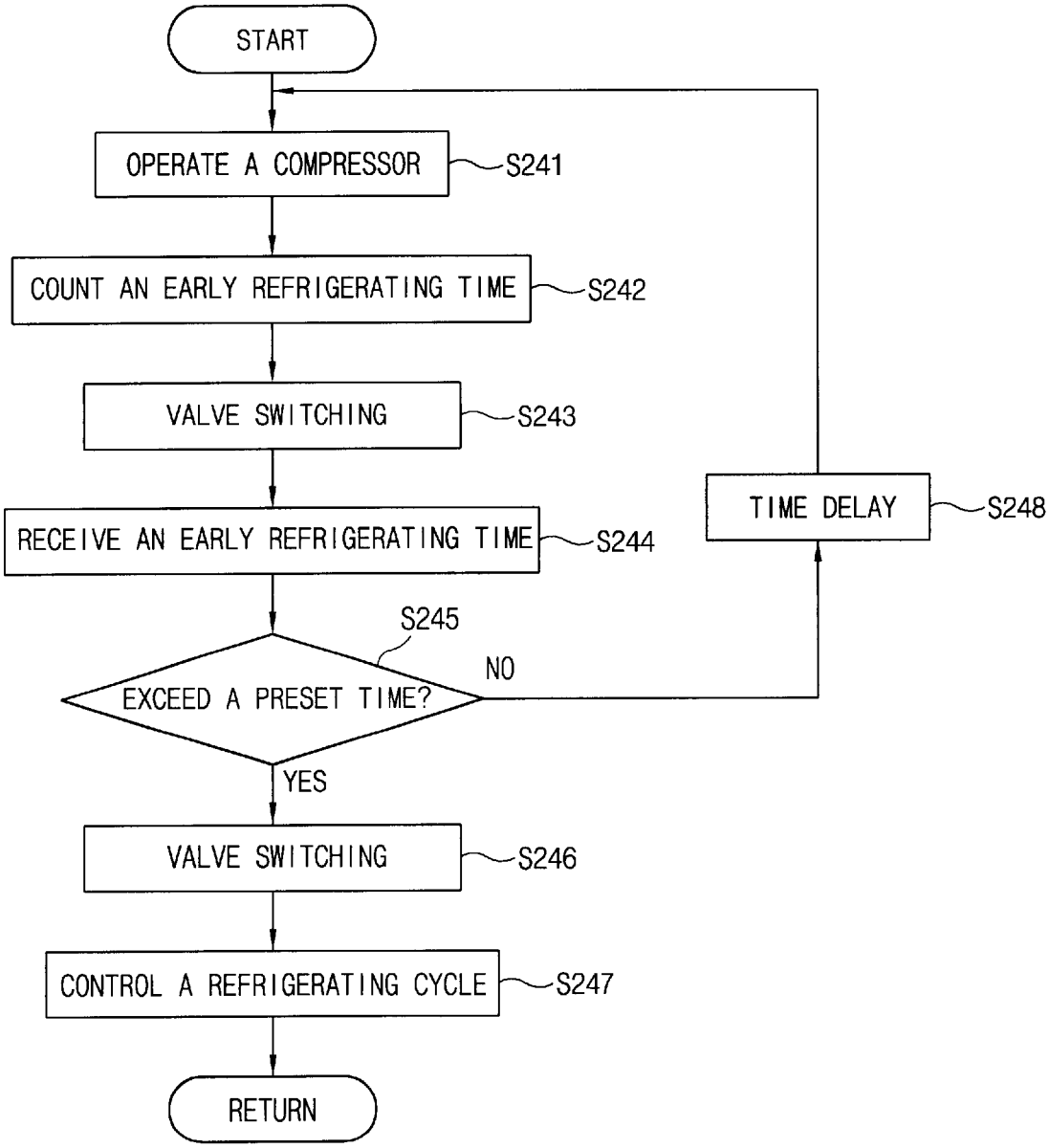
FIG. 23 is a flow chart illustrating operation of an apparatus for controlling a refrigerating cycle of a refrigerator in accordance with the fourth embodiment of the present invention.

FIG. 23 is a flow chart illustrating operation of an apparatus for controlling a refrigerating cycle of a refrigerator in accordance with the fourth embodiment of the present invention.

First, when power is applied to the refrigerator, the microcomputer 234 outputs a signal for operating the compressor 239 to the compressor driving unit 237.

The compressor 239 is driven by the control of the compressor driving unit 237 and generates a high temperature-high pressure refrigerant as shown at step S241. Herein, the refrigerant generated from the compressor 239 is supplied to the freezing chamber or the chilling chamber through the three-way stepping motor valve 238 in the open state according to the control signal of the microcomputer 234.

After, the counter 235 counts from the early operation time point of the compressor 239 to the driving time of the compressor 239 as shown at step S242.

The microcomputer 234 is inputted sensing signals of the first temperature sensing unit 231 or the second temperature sensing unit 232 or additional sensors 9not shown) and judges whether it changes a present refrigerating cycle into another refrigerating cycle.

When the present refrigerating cycle has to be converted into another refrigerating cycle according to the sensing signals, in other words, when the three-way stepping motor valve 238 has to be switched as shown at step S243, the microcomputer 234 receives the early refrigerating time of the compressor 239 counted in the counter 235 as shown at step S244.

After, the microcomputer 234 judges whether the received early refrigerating time exceeds the preset time as shown at step S245. In more detail, in the early operation state of the compressor 239, because the refrigerating cycle of the freezing chamber or the chilling chamber does not operate, the refrigerating of the freezing chamber or the chilling chamber can not be performed. Accordingly, the refrigerant circulating in the refrigerating cycle is in an unstable state (not sufficiently cooled). Therefore, the refrigerant circulating in the refrigerating cycle can be in a stable state after passing the preset time since the compressor 239 operates. Herein, in step S245 for judging whether the early refrigerating time exceeds the preset time, a time is judged in which the present operating refrigerating cycle reaches to a cycle balance.

In the meantime, when the received early refrigerating time does not exceed the preset time, the refrigerant flowing in the refrigerating cycle is in the highly unstable state. Herein, the pressure difference between the inlet and the outlet of the three-way stepping motor valve 238 is very big. Accordingly, the microcomputer 234 waits until the pressure difference between the inlet and the outlet of the three-way stepping motor valve 238 is reduced. Herein, a time point indicating the reduction of the pressure difference between the inlet and the outlet of the three-way stepping motor valve 238 means a time point in which the refrigerating cycle reach to the cycle balance. In more detail, when the received early refrigerating time does not exceed the preset time (60 minutes~80 minutes), the microcomputer 234 stops the operation of the refrigerating cycle until the received early refrigerating time reaches to the preset time (60 minutes~80 minutes) as shown at step S248.

On the contrary, when the received early refrigerating time exceeds the preset time, the microcomputer 234 switches the three-way stepping motor valve 238 in order to supply the cold air to the freezing chamber or the chilling chamber. In more detail, when the received early refrigerating time exceeds the preset time, the microcomputer 234 outputs a driving signal to the valve driving unit 236. The valve driving unit 236 is inputted the driving signal from the microcomputer 234 and switches the three-way stepping motor valve 238 as shown at step S246. When the three-way stepping motor valve 238 is switched, the cold air is supplied to the freezing chamber or the chilling chamber through the switched valve.

After, the microcomputer 234 controls the operation of the refrigerating cycle by receiving each temperature of the freezing chamber and the chilling chamber from the first and the second temperature sensing unit s 231, 232 until the temperature of the freezing chamber and the chilling chamber reaches to the set temperature as shown at step S247.

Hereinafter, a time point in which the three-way stepping motor valve 238 switches easily and smoothly in the early operation of the compressor 239 will now be described in detail with reference to accompanying FIG. 24.

Figure 24:
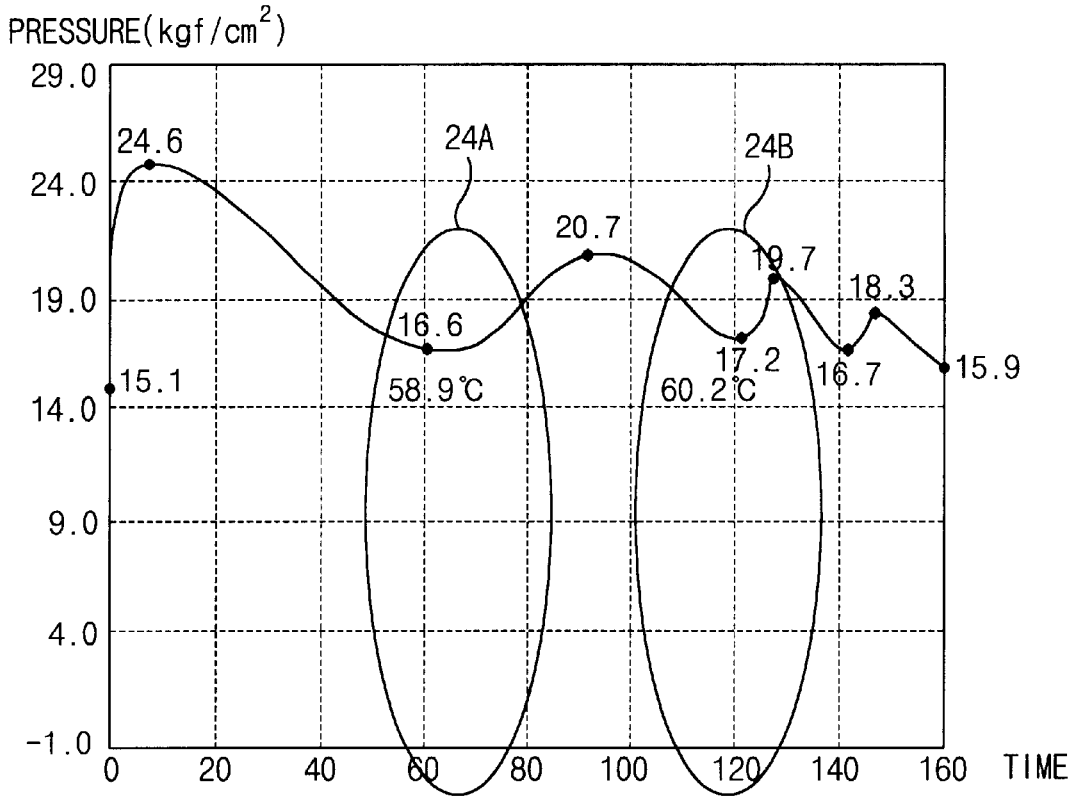
FIG. 24 is a wave diagram illustrating a time point for smoothly switching the three-way stepping motor valve a refrigerating cycle of a refrigerator in accordance with the fourth embodiment of the present invention.

FIG. 24 is a wave diagram illustrating a time point for smoothly switching the three-way stepping motor valve a refrigerating cycle of a refrigerator in accordance with the fourth embodiment of the present invention.

As depicted in FIG. 24, in the early operation of the compressor 239, it maintains a very high pressure state until it reaches to a certain time point. Accordingly, as depicted in ovals 24A, 24B of FIG. 24, until the pressure is lowered to a certain value, the switching time point of the three-way stepping motor valve 238 is delayed.

As described above, in the refrigerator operating the plurality of evaporators with one compressor 239, in the early operation of the refrigerating cycle, the switching time point of the three-way stepping motor valve 238 passing or shutting the refrigerant discharged into the freezing chamber or the chilling chamber is set as a time point passing a certain time (the preset time) from the early operation of the compressor 239. In more detail, because the three-way stepping motor valve 238 is switched at the time point in which the pressure at the inlet side of the three-way stepping motor valve 238 is not greater than the certain valve (about 18 kgf/cm$^2$), the three-way stepping motor valve operates (is switched) normally and easily. In addition, because the three-way stepping motor valve 238 operates normally, an operation efficiency of the refrigerating system is improved and the credibility about products can be heighten.

Hereinafter, the operation for controlling the early operation of the refrigerating cycle according to the present invention will be described in detail with reference to accompanying FIGS. 21, 22, 25 and 26.

Figure 25:
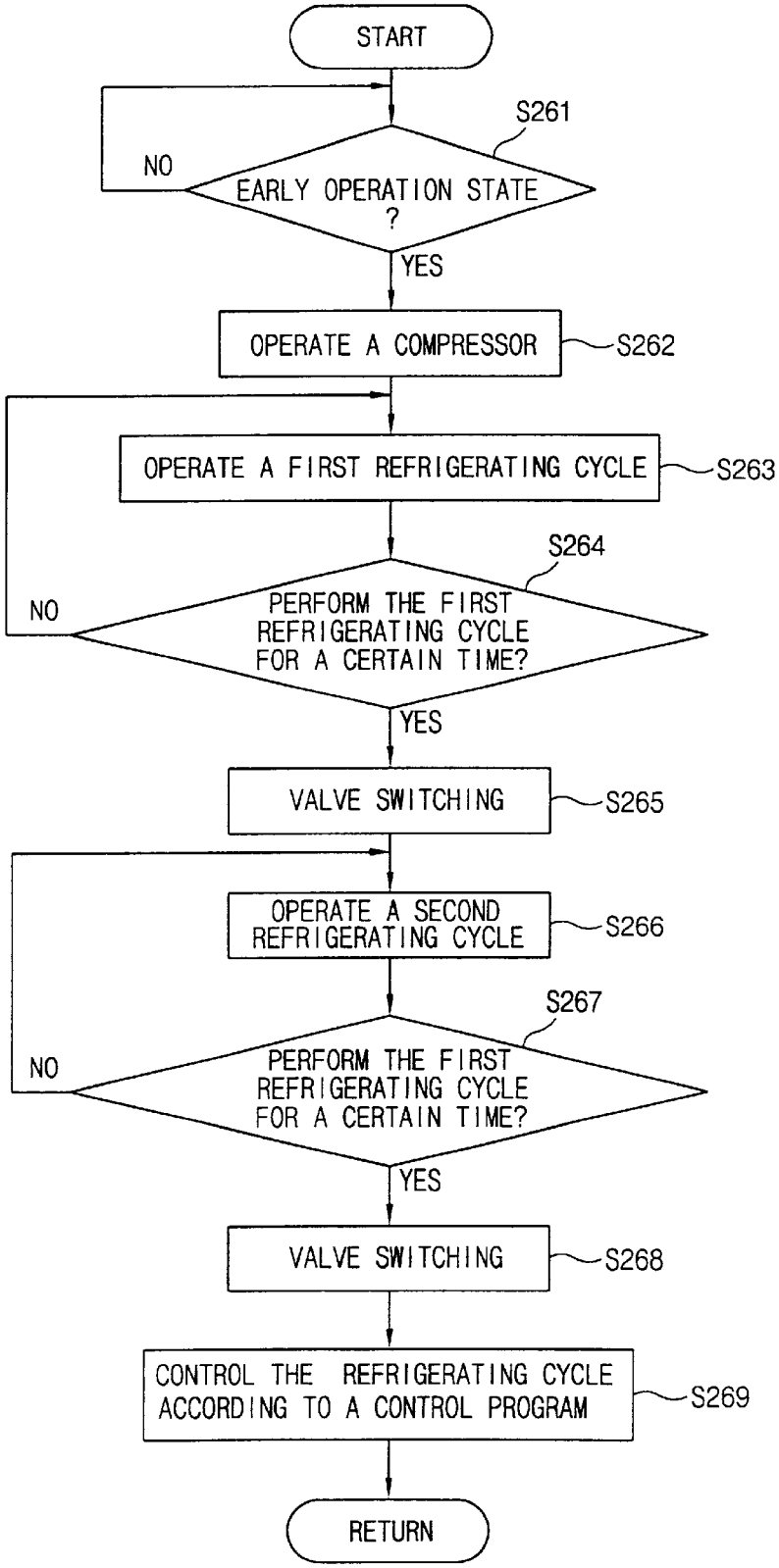
FIG. 25 is a flow chart illustrating operation of an apparatus for controlling a refrigerating cycle of a refrigerator in accordance with a fifth embodiment of the present invention.

FIG. 25 is a flow chart illustrating operation of an apparatus for controlling a refrigerating cycle of a refrigerator in accordance with a fifth embodiment of the present invention.

Figure 26:
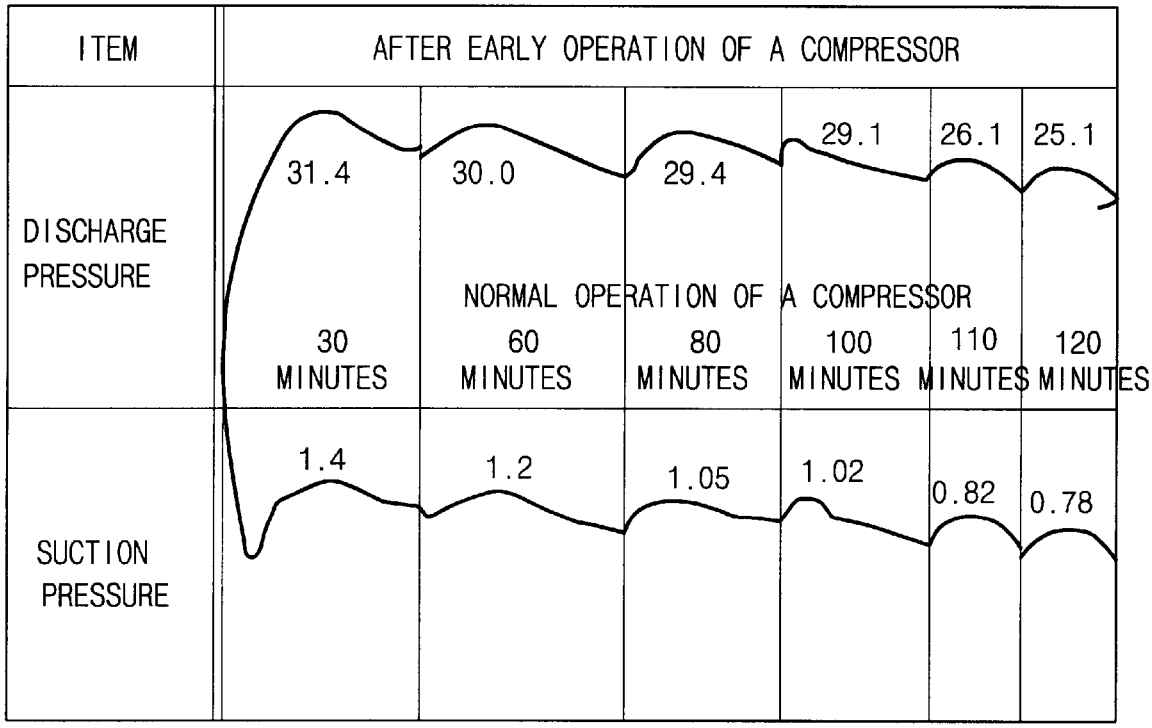
FIG. 26 is a graph illustrating characteristics of a refrigerant suction pressure and a refrigerant discharge pressure of a compressor a refrigerator in accordance with the fifth embodiment of the present invention.

FIG. 26 is a graph illustrating characteristics of a refrigerant suction pressure and a refrigerant discharge pressure of a compressor a refrigerator in accordance with the fifth embodiment of the present invention.

First, the microcomputer 234 judges whether the first refrigerating cycle is the early operation as shown at step S261. Herein, when it is judged the first refrigerating cycle is not in the early operation, the microcomputer 234 does not perform the operation of the apparatus for controlling the refrigerating cycle of the refrigerator according to the fifth embodiment of the present invention.

On the contrary, when it is judged the first refrigerating cycle is in the early operation, the microcomputer 234 operates the compressor 239 so as to supply the cold air to the freezing chamber as shown at step S262, accordingly the first refrigerating cycle operates as shown at step S263. Herein, in the early operation of the compressor 239, a suction pressure (1.4 kgf/cm$^2$) and a discharge pressure (31.3 kgf/cm$^2$) of the compressor 239 are very high as depicted in FIG. 26.

After, the microcomputer 234 judges whether the first refrigerating cycle is operated for a certain time, when the first refrigerating cycle is operated for a certain time (30 minutes), the operation of the first refrigerating cycle is stopped, the three-way stepping motor valve 238 is switched in order to operate the second refrigerating cycle. Herein, the first refrigerating cycle is for supplying the cold air to the freezing chamber, and the second refrigerating cycle is for supplying the cold air to the chilling chamber.

After, it is judged the first refrigerating cycle is not operated more than 30 minutes, the microcomputer 234 operates the first refrigerating cycle continuously as shown at step S264.

On the contrary, when the first refrigerating cycle is operated more than 30 minutes, the temperature inside the freezing chamber is lowered and the suction pressure and the discharge pressure are reduced as depicted in FIG. 26.

In the meantime, when the second refrigerating cycle is operated by the switching of the three-way stepping motor valve 238, the suction pressure and the discharge pressure of the compressor 239 is same as the suction pressure and the discharge pressure at the early operation end time point of the first refrigerating cycle as shown at step S265. In more detail, the microcomputer 234 operates the second refrigerating cycle for a certain time (30 minutes) same as in the first refrigerating cycle as shown at step S266.

After, the microcomputer 234 switches the three-way stepping motor valve 238 in order to operate the first refrigerating cycle by ordering the valve switching to the valve shaft 75 when the second refrigerating cycle is operated more than the preset time (30 minutes) as shown at step S267 and step S268. Herein, the preset time (30 minutes) is stored in the microcomputer 234. Herein, when the second refrigerating cycle is operated for 30 minutes, the suction pressure and the discharge pressure of the refrigerant of the compressor 239 are decreased. In more detail, when the first and the second refrigerating cycles are operated more than 30 minutes, the suction pressure and the discharge pressure of the compressor 239 are decreased gradually and the compressor 239 operates normally. Accordingly, in the early operation of the compressor 239, because the suction pressure (1.4 kgf/cm$^2$) and the discharge pressure (31.4 kgf/cm$^2$) of the compressor 239 are high, it is possible to prevent an abrupt stop of the compressor 239 during the operation.

For example, when the first and the second refrigerating cycles are operated more than 30 minutes at the early stage, the refrigerating cycle of the refrigerator reaches to a cycle balance. Herein, reaching to the cycle balance means the temperature sensed by the first and the second temperature sensing units 231, 232 reach to the preset temperature stored in the microcomputer 234. In the experimental result of the present invention, the first and the second refrigerating cycles have to be operated more than 30 minutes in order to make the first and the second refrigerating cycles reach to the cycle balance. In addition, when both the first and the second refrigerating cycles finish the early operation for 30 minutes, the suction pressure and the discharge pressure of the compressor 239 are decreased regardless of the operation time of the refrigerating cycle, accordingly it is possible to prevent an abrupt stop of the compressor 239 during the operation.

In the meantime, after the completion of the early operation the refrigerating cycle reaches to the cycle balance, an operation mode at this time is called as a normal operation mode. In addition, in the early operation mode, when the discharge pressure of the compressor 239 is reduced to lower than 32 kgf/cm$^2$ at the early operation mode, the refrigerating cycle reaches to the cycle balance after the completion of the early operation mode.

Figure 27:
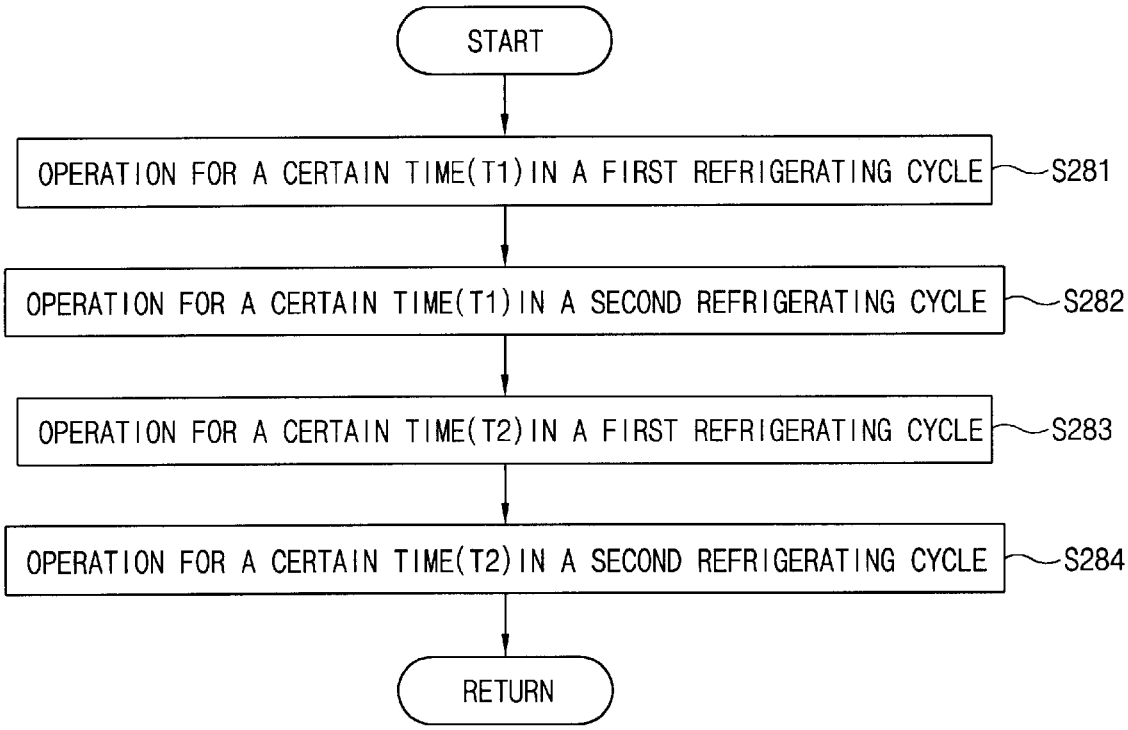
FIG. 27 is a flow chart illustrating a control operation after ending an early operation of a refrigerating cycle of a refrigerator in accordance with the fifth embodiment of the present invention.

FIG. 27 is a flow chart illustrating a control operation after ending an early operation of a refrigerating cycle of a refrigerator in accordance with the fifth embodiment of the present invention.

First, after the early operation of the first and the second refrigerating cycles are finished, the first refrigerating cycle and the second refrigerating cycle are operated by turns for 20 minutes as shown at step S281 and step S282.

After operating the first refrigerating cycle and the second refrigerating cycle by turns for 20 minutes, the first refrigerating cycle and the second refrigerating cycle are operated by turns for 10 minutes as shown at step S283 and step S284.

As described above, by setting and controlling the operation time of the first refrigerating cycle and the second refrigerating cycle in the microcomputer 234, as depicted in FIG. 26, the suction pressure and the discharge pressure of the compressor 239 are decreased gradually. Herein, 20 minutes or 10 minutes for cooling the freezing chamber and the chilling chamber after the completion of the early operation of the first and the second refrigerating cycles is related to a refrigerating speed, is not related to a method for preventing an abrupt stop of the compressor 239 during the operation. In more detail, by setting the early operation (cooling) time of the first and the second refrigerating cycles more than the certain time (30 minutes), regardless of the refrigerating time after the completion of the early operation of the first and the second refrigerating cycles, the suction pressure and the discharge pressure of the compressor 239 are gradually stabilized, and the first and the second refrigerating cycles reach to the cycle balance.

As described above, by controlling the opening and shutting of the three-way stepping motor valve according to the rotation of the rotor inside the three-way stepping motor valve, noise occurred in the transferring of the plunger can be restrained.

In addition, in an apparatus and a method for controlling a refrigerating cycle of a refrigerator in accordance with the present invention, by using the three-way stepping motor valve a poser consumption can be reduced greater than 9 watt~14 watt in comparison with using the conventional two-way valve In addition, in an apparatus and a method for controlling a refrigerating cycle of a refrigerator, by using the three-way stepping motor valve, a wiring according to the conventional valve control can be reduced, weld zones according to the wiring can be reduced, and a production cost can be reduced.

In addition, in an apparatus and a method for controlling a refrigerating cycle of a refrigerator in accordance with the present invention, in order to reduce the refrigerant pressure at the inlet side of the three-way stepping motor valve 214, an expansion valve is installed at the inlet side of the three-way stepping motor valve 214 in order to depress the refrigerant, accordingly the refrigerator can operate normally by switching the three-way stepping motor valve 214 easily.

In addition, in an apparatus and a method for controlling a refrigerating cycle of a refrigerator, without installing the expansion valve at the front end of the first and the second evaporators 225, 226, a production cost can be reduced.

In addition, in an apparatus and a method for controlling a refrigerating cycle of a refrigerator in accordance with the present invention, because the three-way stepping motor valve 228 is switched when the pressure at the inlet side of the three-way stepping motor valve 238 is lowered to not greater than a certain valve (about 18 kgf/cm$^2$), the three-way stepping motor valve 238 can operate normally and easily.

In addition, in an apparatus and a method for controlling a refrigerating cycle of a refrigerator in accordance with the present invention, because the three-way stepping motor valve 238 operates normally, an operation efficiency of the refrigerating system is improved and the credibility about products can be heighten.

In addition, in an apparatus and a method for controlling a refrigerating cycle of a refrigerator in accordance with the present invention, by operating the first and the second refrigerating cycles more than a preset time, a suction pressure and a discharge pressure of the refrigerant of the compressor 239 can be reduced without additional apparatus, accordingly an abrupt stop of the compressor 239 during the operation can be prevented.

In addition, in an apparatus and a method for controlling a refrigerating cycle of a refrigerator in accordance with the present invention, when a pressure in the compressor is maintained so as to be lower than a certain pressure, the first and the second refrigerating cycles can reach to a cycle balance.

What is claimed is:

1. In a refrigerating apparatus supplying cold air to a food storage chamber by constructing a refrigerating cycle, an apparatus for controlling a refrigerating cycle of the refrigerating apparatus, comprising:

a microcomputer configured for outputting a control signal;

a compressor configured for receiving the control signal and compressing a refrigerant;

a three-way stepping motor valve configured for receiving the control signal and selectively passing or shutting the refrigerant discharged from the compressor according to the control signal into each of a plurality of refrigerant pipes; and a plurality of evaporators each separately configured for being supplied the refrigerant from a respective refrigerant pipe and supplying cold air to a food storage chamber.

2. The apparatus of claim 1, wherein the three-way stepping motor valve is installed at inlet sides of the plurality of evaporators.

3. The apparatus of claim 1, wherein the three-way stepping motor valve is installed at outlet sides side of the plurality of evaporators.

4. The apparatus of claim 1, further comprising:

a condenser connected to the compressor and configured for radiating heat of the refrigerant;

a drier connected to the condenser and configured for removing humidity from the refrigerant discharged from the condenser; and a plurality of expansion valves, wherein each expansion valve is connected between the three-way stepping motor valve and one of the plurality of evaporators and configured for reducing the pressure of the refrigerant separately supplied to the plurality of evaporators.

5. The apparatus of claim 1, wherein the microcomputer controls a rotation and a reverse-rotation of the three-way stepping motor valve.

6. The apparatus of claim 1, wherein the three-way stepping motor valve comprises:

a motor unit constructed with a stator and a rotor;

a valve shaft configured to be rotated by the rotor and having an open region and a shut region in order to control flow of the refrigerant; and a valve housing covering the valve shaft and having a plurality of output ports and input ports opened and shut by the open region and the shut region.

7. The apparatus of claim 1, wherein the three-way stepping motor valve comprises:

a motor unit constructed with a stator and a rotor;

a valve shaft having a rotor cam rotated by the rotor;

a valve housing covering the valve shaft and having input and output ports opened and shut movement of the valve shaft; and a plurality of sealing balls configured for opening and shutting the plurality of output ports by being transferred by the rotor cam.

8. An apparatus for controlling a refrigerating cycle of a refrigerator, comprising:

a microcomputer configured for outputting a control signal;

a compressor configured for receiving the control signal and compressing a refrigerant;

a condenser configured for receiving and condensing the refrigerant compressed in the compressor;

a first expansion valve configured for receiving the refrigerant and reducing a pressure of the refrigerant;

a n-direction stepping motor valve having inlet and outlet ports and configured for receiving the refrigerant from the first expansion valve and selectively shutting or passing the refrigerant to a plurality of refrigerant pipes according to the control signal;

a plurality of second expansion valves configured for receiving and reducing the pressure of the refrigerant discharged from the n-direction stepping motor valve; and a plurality of evaporators configured for being supplied the refrigerant discharged from a respective second expansion valve and supplying cold air to a food storage chamber.

9. The apparatus of claim 8, wherein the n-direction stepping motor valve is connected to the first expansion valve through a refrigerant pipe and selectively opens and shuts the refrigerant pipe.

10. The apparatus of claim 8, wherein the number of ports of the n-direction stepping motor valve is greater by 1 than the number of the evaporators and not less than 3.

11. An apparatus for controlling a refrigerating cycle of a refrigerator, comprising:

a microcomputer configured for outputting a control signal;

a compressor configured for receiving the control signal and compressing a refrigerant;

a condenser configured for condensing the refrigerant compressed in the compressor;

a first expansion valve configured for receiving and reducing the pressure of the refrigerant condensed in the condenser;

a n-direction stepping motor valve having inlet and outlet ports and configured for receiving the control signal and refrigerant and selectively shutting or passing the refrigerant according to the control signal into each of a plurality of refrigerant pipes; and a plurality of evaporators configured for being supplied the refrigerant discharged from a respective refrigerant pipe and supplying cold air to a food storage chamber.

12. The apparatus of claim 11, wherein the n-direction stepping motor valve is connected to the first expansion valve through a refrigerant pipe and selectively opens and shuts the refrigerant pipe.

13. The apparatus of claim 11, wherein the number of ports of the n-direction stepping motor valve is greater by 1 than the number of the evaporators and not less than 3.

14. An apparatus for controlling a refrigerating cycle of a refrigerator, comprising:

a compressor configured for compressing a refrigerant;

a three-way stepping motor valve configured for selectively opening and shutting refrigerant pipes connected to a freezing chamber and a chilling chamber in order to selectively supply the refrigerant compressed in the compressor to each of the freezing chamber and the chilling chamber through a respective refrigerant pipe;

a counter configured for counting an early refrigerating time according to an early operation of the compressor; and a microcomputer configured for switching the three-way stepping motor valve on the basis of the counted early refrigerating time.

15. The apparatus of claim 14, wherein the microcomputer switches the three-way stepping motor valve when the counted early refrigerating time exceeds a prescribed time.

16. In a method for controlling a refrigerating cycle of a refrigerator by being supplied a refrigerant compressed in a compressor and evaporating the refrigerant, a method for controlling a refrigerating cycle of a refrigerator, comprising:

selectively opening and shutting each of a plurality of refrigerant pipes connected to a freezing chamber and a chilling chamber in order to selectively supply a refrigerant compressed in a compressor to either or both of the freezing chamber and the chilling chamber through the refrigerant pipes;

counting an early refrigerating time according to an early operation of the compressor;

determining whether the early refrigerating time exceeds a prescribed time; and selectively opening and shutting each of the refrigerant pipes connected to the freezing chamber and the chilling chamber, respectively, when the early refrigerating time exceeds the prescribed time.

17. An apparatus for controlling a refrigerating cycle of a refrigerator, comprising:

a microcomputer configured to output a control signal; and a valve for controlling refrigerant flow, the valve receiving the control signal from the microcomputer, comprising:

a valve housing comprising an inlet section with at least one port and an outlet section with at least one port, wherein the valve housing comprises a total of at least 3 ports; and a valve shaft rotatably disposed within the valve housing and configured to control a refrigerant flow from any combination of ports in the inlet section to any combination of ports in the outlet section in accordance with the control signal.

18. The apparatus of claim 17, wherein the outlet section comprises two outlet ports, wherein each of the two outlet ports is connected to a respective expansion valve.

19. The apparatus of claim 17, wherein a port in the inlet section of the valve housing is connected to an expansion valve.

20. The apparatus of claim 19, wherein the outlet section comprises two outlet ports, and wherein each of the two outlet ports is connected to an expansion valve.

* * * * *